US007547838B2

(12) United States Patent
Okuyama et al.

(10) Patent No.: US 7,547,838 B2
(45) Date of Patent: Jun. 16, 2009

(54) TUNING DEVICE FOR MUSICAL INSTRUMENTS AND COMPUTER PROGRAM USED THEREIN

(75) Inventors: Fukutaro Okuyama, Shizuoka-ken (JP); Rei Furukawa, Shizuoka-Ken (JP)

(73) Assignee: Yamaha Corporation, Shizuoka-ken (JP)

( * ) Notice: Subject to any disclaimer, the term of this patent is extended or adjusted under 35 U.S.C. 154(b) by 110 days.

(21) Appl. No.: 11/541,944

(22) Filed: Oct. 2, 2006

(65) Prior Publication Data

US 2007/0079688 A1 Apr. 12, 2007

(30) Foreign Application Priority Data

Oct. 12, 2005 (JP) ..... 2005-297700

(51) Int. Cl.
*G10G 7/02* (2006.01)

(52) U.S. Cl. ..... 84/454; 84/455; 84/616

(58) Field of Classification Search ..... None
See application file for complete search history.

(56) References Cited

U.S. PATENT DOCUMENTS

| | | | | |
|---|---|---|---|---|
| 4,327,623 | A * | 5/1982 | Mochida et al. | 84/454 |
| 4,429,609 | A * | 2/1984 | Warrender | 84/454 |
| 4,510,840 | A * | 4/1985 | Inami et al. | 84/477 R |
| 5,973,252 | A * | 10/1999 | Hildebrand | 84/603 |
| 2004/0144235 | A1 * | 7/2004 | Taku | 84/454 |

FOREIGN PATENT DOCUMENTS

| | | |
|---|---|---|
| DE | 121216 | 7/1976 |
| DE | 3013681 | 10/1980 |
| JP | 03-042412 | 6/1983 |
| JP | 05-313657 | 11/1993 |

OTHER PUBLICATIONS

"Calibrating the Pitch of Your Pocket PC", [online], May 30, 2005, p. 1, XP002414249; http://web.archive.org/web/20050530202737/www.reyburn.com/pub/reyburn/rct_demo/PRCT+Blue+calibrate+sheet.pdf.

"Reyburn CyberTuner V. 3.0" [online], Reyburn, Kiel; Jun. 5, 2001 (pp.0-144, XP002414248; http://web.archive.org/web/20010605111511/www.reyburn.com/pub/reyburn/rct_demo/rct3man.pdf.

* cited by examiner

*Primary Examiner*—Marlon T Fletcher
(74) *Attorney, Agent, or Firm*—Harness, Dickey & Pierce, PLC

(57) ABSTRACT

A tuning device includes an analog-to-digital converter for converting sound waves propagated from a piano to an audio signal in synchronism with a sampling signal and a data processor for visualizing a difference between a target pitch of a tone and an actual pitch of the tone; since the sampling signal is less accurate in frequency, the data processor previously determines the frequency difference between a design frequency and an actual frequency of the sampling signal by using a calendar clock signal as a measure; the data processor eliminates noise due to the sampling signal from visual images of the pitch difference, and makes the visual images more accurate.

20 Claims, 9 Drawing Sheets

TUNING DEVICE FOR MUSICAL INSTRUMENTS AND COMPUTER PROGRAM USED THEREIN

FIELD OF THE INVENTION

This invention relates to a tuning device for musical instruments and, more particularly, to a tuning device implemented by a general-purpose information processing device such as, for example, a personal computer system, a personal digital assistants, which is usually abbreviated as "PDA", or the likes for discriminating difference in frequency from the pitch of a target tone in a tuning work on a musical instrument and a computer program used therein.

DESCRIPTION OF THE RELATED ART

The tuning device is designed to assist a user in a tuning work on a musical instrument. While the user is producing tones in the musical instrument, the tuning device analyzes the sound waves for the pitch name, octave and difference from a target pitch, i.e., current tuning status of the musical instrument, and notifies the user of the current tuning status through visual images.

A typical example of the prior art tuning device is disclosed in Japanese Patent Publication No. Hei 3-42412. The prior art method disclosed in the Japanese Patent Publication is hereinafter briefly described. While the sound waves are being supplied from a musical instrument to the prior art tuning device, the tuning device converts the sound waves to an audio input signal, and produces a pulse train from the audio input signal. While the audio input signal is keeping the potential level over zero, the prior art tuning device also keeps the pulse at the high level. The pulse is decayed to the low level at the transit of the audio input signal to the negative. If the audio input signal keeps the potential level over zero for a long time, the corresponding pulse has a long pulse width. On the other hand, if the audio input signal keeps the potential level over zero for a short time, the pulse width of the corresponding pulse is made short. Thus, the irregular pulses form the pulse train with the variable pulse width.

The prior art tuning device introduces a delay time, which is equal to the time period from the first pulse rise to the next pulse rise, into the original pulse train, and produces the first delayed pulse train. A delay time, which is equal to the time period from the second pulse rise to the next pulse rise, is further introduced into the first delayed pulse train, and produces the second delayed pulse train. In this manner, the delay times, which are respectively equal to the pulse intervals of the original pulse train, are successively introduced into the delayed pulse trains.

Subsequently, the prior art tuning device checks the delayed pulse trains for the correlation with the original pulse train. If the total amount of delay time is equal to the major repetition period of the audio input signal which strongly relates to the pitch of the tone, the correlation with the original pulse train is found to be high. On the other hand, if the total amount of delay time is different from the major repetition period of the audio input signal, the delayed pulse train has a low value of the correlation with the original pulse train. Thus, the pitch of tone on the sound waves is determinable through the correlation analysis on the delayed pulse trains in spite of undesirable influences of short repetition periods on the audio input signal. The prior art tuning device disclosed in the Japanese Patent Publication is hereinafter referred to as "the first prior art tuning device".

The prior art tuning devices inform the users of the difference between the target pitch and the actual pitch in various ways. A prior art tuning device, which is disclosed in Japanese Patent Application laid-open No. Hei 5-313657, informs the user of the difference between the target pitch and the actual pitch of a tone through a lighting pattern on an array of light emitting diodes.

In detail, a row of plural light emitting diodes is provided on the prior art tuning device, and the plural light emitting diodes are selectively energized depending upon the phrase difference between the audio signal representative of the tone produced through a musical instrument and a reference signal representative of the target pitch. A counter is prepared for the reference signal, and switching transistors are connected between the anodes of the light emitting diodes and a power source. A low pass filter is further prepared for the audio signal, and a common switching transistor is connected between the cathodes of the light emitting diodes and the ground.

The counter is incremented by the reference signal, and the plural bits of an output signal are supplied in parallel from the counter to the control nodes of the switching transistors. The output signal of the counter causes the switching transistors sequentially to turn on. Thus, the light emitting diodes sequentially get ready for emitting the light depending upon the frequency of the reference signal. On the other hand, the low-pass filter eliminates high-frequency noise components from the audio signal, and the audio signal causes the common switching transistor to turn on depending upon the fundamental frequency of the audio signal. As a result, a current path is established between the power source and the ground only when the reference signal and audio signal concurrently change the common switching transistor and the switching transistor associated with each light emitting diode to the on-state. Thus, the light emitting diodes are selectively turns on and off so as to form a light pattern on the array of light emitting diodes.

If the audio signal is equal in frequency to the reference signal, all the light emitting diodes regularly turn on, and the light pattern is seemed to stay on the array of light emitting diodes. On the other hand, if the audio signal is different in frequency from the reference signal, the light emitting diodes irregularly turn on and off, and the light pattern is seemed to move on the array of light emitting diodes. Thus, the prior art tuning device notifies the user of the frequency difference through the movement of the light pattern.

It is possible to set a personal computer system or personal digital assistants to the above-described tuning works. In other words, the computer programs make the personal computer system or personal digital assistants serve as the prior art tuning devices. The audio signal is sampled to discrete values of potential level with a sampling signal, and the discrete values are converted to digital codes expressing binary numbers equivalent to the discrete values. The prior art computer program runs on the microprocessor in the personal computer system or personal digital assistants, and determines the actual pitch of tones and the difference between the fundamental frequency of the audio signal and the frequency of the reference signal. The sampling signal is designed in the personal computer system or Personal digital assistants to have 44.1 kHz or 22.5 kHz, by way of example. The frequency, which the sampling signal is to have, is hereinafter referred to as "design frequency".

The sampling signal tends to exhibit the frequency different from the design frequency. The frequency, which the sampling signal actually has, is hereinafter referred to as "actual frequency". The present inventors confirmed that the difference between the design frequency and the actual frequency fell into the range from 1 cent to 10 cent. On the other hand, pianos are, by ways of example, to be tuned to produce the tones, the actual pitch of which is merely allowed to be deviated from the target pitch by 0.2 cent at the maximum. As well known to persons skilled in the art, the term "cent" is the unit of pitch difference, and the semitone in the temperament is equivalent to 100 cents. Since the pitch of tones uniquely corresponds to values of frequency on the condition that a particular value is given to the standard pitch, it is possible to express the difference of frequency in cent. In the following description, the difference between the design frequency and the actual frequency is expressed in "cent".

As described hereinbefore, the prior art tuning device, which are implemented by a personal computer system or personal digital assistants, analyzes the audio signal through the correlation on the digital codes expressing the discrete values on the audio waveform, and the pitch difference is determined on the assumption that the discrete values are sampled with the sampling signal at the design frequency. Although the sampling signal has the frequency difference fallen within the range between 1 cent to 10 cents, the pitch of tones is only allowed to have the pitch difference of 0.2 cent at the maximum. In this situation, it is apparent that the personal computers, personal digital assistants and the likes are not available for the tuning work. If the manufacturers do not take the difference between the design frequency and the actual frequency into account, the prior art tuning device, which is implemented by a general-purpose information processing device such as, for example, the personal computer system and personal digital assistants, is less reliable. On the other hand, when the manufacturers design the prior art tuning-device to be exclusively used in the tuning work, the production cost is so high that the prior art tuning device would be sold at a high price. Thus, there is a trade-off between the price and the reliability.

SUMMARY OF THE INVENTION

It is therefore an important object of the present invention to provide a tuning device, which offers a piece of accurate tuning information to a tuning worker regardless of an actual frequency of a sampling clock deviated from a design frequency.

It is also an important object of the present invention to provide a computer program, which is installed in the tuning device.

The present inventors contemplated the problem inherent in the general-purpose information processing devices, and noticed that the general-purpose information processing device was available for the tuning work in so far as the difference between the design frequency and the actual frequency was known. If a reference signal was produced exactly at the design frequency such as, for example, 440 Hz, the frequency difference was precisely determinable through the correlation carried out in the general-purpose information processing device serving as the tuning device. However, the high-precision oscillator was so expensive that the manufacturer could not reduce the production cost. Since the audio player such as a CD (Compact Disk) player was popular to the music fans, the present inventors investigated the audio players to see whether or not the audio players were used as an origin of the reference signal. However, the clock signals in the audio players had the serious frequency difference from the design frequency. Moreover, the sampling signal for the input signal was different from the sampling signal for the output signal in several models of the audio players. Thus, the present inventors concluded that the audio players were not available for producing the reference signal precisely at the design frequency.

The present inventors finally noticed that a high-precision oscillator, which produced a periodical signal more accurate than the sampling signal, was usually incorporated in the general-purpose information processing device, and concluded that the frequency difference was to be determined with the periodical signal output from the high-precision oscillator.

To accomplish the object, the present invention proposes to carry out the tuning work on the basis of the actual frequency of the sampling signal.

In accordance with one aspect of the present invention, there is provided a tuning device for assisting a worker in a tuning work on a musical instrument comprising an input circuit for converting sound waves to an audio signal expressing music sound produced in the musical instrument in synchronism with a sampling clock having a design frequency with a relatively low accuracy, a determiner supplied with a reference signal having a design frequency with a relatively high accuracy and determining a deviation between the design frequency of the sampling clock and an actual frequency of the sampling clock by using the reference signal as a measurer, and an informant supplied with the audio signal, and producing a piece of tuning information expressing tuning status of the musical instrument on the basis of an actual frequency of the audio signal and the deviation.

In accordance with another aspect of the present invention, there is provided a computer program for producing a piece of tuning information expressing tuning status of the musical instrument, comprising the steps of a) receiving a sampling clock having a design frequency with a relatively low accuracy and a reference signal having a design frequency with a relatively high accuracy, b) determining a deviation between the design frequency of the sampling clock and an actual frequency of the sampling clock by using the reference signal as a measurer, and c) producing a piece of tuning information expressing tuning status of the musical instrument on the basis of an actual frequency of the audio signal and the deviation.

BRIEF DESCRIPTION OF THE DRAWINGS

The features and advantages of the tuning device and computer program will be more clearly understood from the following description taken in conjunction with the accompanying drawings, in which FIG. 10 is a view showing a method for visualizing phrase difference carried out in the tuning device.

DESCRIPTION OF THE PREFERRED EMBODIMENTS

Figure 1:
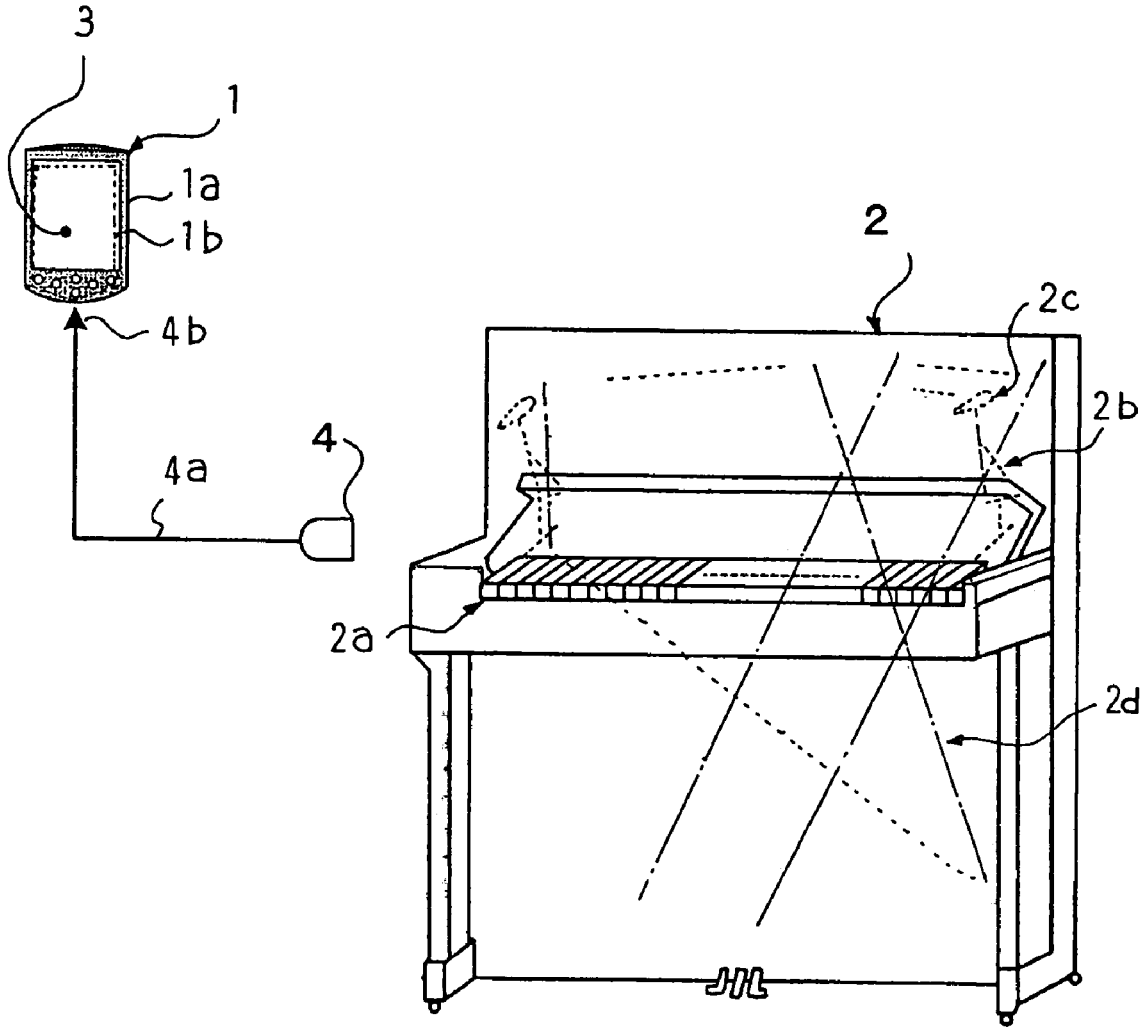
FIG. 1 is a schematic perspective view showing a tuning device of the present invention and an upright piano.

A tuning device embodying the present invention offers assistance in a tuning work on a musical instrument to a worker, and comprises an input circuit, a determiner and an informant. Music sound is produced in the musical instrument, and is propagated to the input circuit as sound waves. Tuning status of the musical instrument is expressed by the music sound or sound waves.

The input circuit and determiner are connected to the informant. In case where a sampling signal and a reference signal are internally produced in the tuning device, the sampling signal is supplied to the input circuit and determiner, and the reference signal is supplied to the determiner. For this reason, the input circuit is not connected to the determiner. If either of or both of the sampling and reference signals are supplied from the outside of the tuning device, the sampling signal and/or reference signal is transferred from the input circuit to the determiner so that the input circuit is further connected to the determiner.

The sampling clock has a design frequency with a relatively low accuracy so that the actual frequency of the sampling clock tends to be deviated from the design frequency. The reference signal has a design frequency with a relatively high accuracy. If the informant produced a piece of tuning information on the basis of the audio signal sampled with the sampling signal without any consideration of the deviation, the pieces of tuning information would be less reliable.

The input circuit is adopted to convert the sound waves to an audio signal expressing the music sound in synchronism with the sampling clock. In order to enhance the reliability, the determiner is incorporated in the tuning device. In detail, the determiner is adapted to determine the deviation between the design frequency and the actual frequency by using the reference signal as a measurer. The deviation is reported from the determiner to the informant, and the audio signal is supplied from the input circuit to the informant. The informant is adapted to produce the piece of tuning information expressing the tuning status of the musical instrument on the basis of an actual frequency of the audio signal and the deviation. The tuning status is carried on the audio signal, and the deviation x expresses a piece of corrective information due to the difference between the design frequency and the actual frequency of the sampling signal. For this reason, the informant can correct the tuning states by using the piece of corrective information. As a result, the piece of tuning information becomes reliable. The piece of tuning information is offered to the worker, and the worker tunes the musical instrument in consideration of the piece of tuning information.

As will be appreciated from the foregoing description, the determiner informs the informant of the deviation between the design frequency and the actual frequency of the sampling signal so that the informant can eliminate the noise due to the deviation of the sampling clock from the piece of tuning information. This results in the piece of reliable tuning information.

In the following description, term "audio clock signal" is used as an equivalent term "sampling signal". The audio clock signal is a series of audio clock pulses.

First Embodiment

Referring to FIG. 1 of the drawings, a portable tuning device 1 embodying the present invention is designed to assist a user in a tuning work on an upright piano 2, and is provided as a PDA (Personal Digital Assistants).

The portable tuning device 1 comprises a housing 1*a*, a data processing system 1*b*, which will be hereinlater described with reference to FIG. 2, a touch-panel display device 3 and a microphone 4. The data processing system 1*b* is provided inside the housing 1*a*, and the touch-panel display device 3 is set in the housing 1*a*. The microphone 4 is connected to a connecting cable 4*a*, and a plug 4*b*, which is provided on the other end of the connecting cable 4*a*, is inserted in a jack (not shown) on the housing 1*a*.

A user directs the microphone 4 to the upright piano 2, and depresses one of the black and white keys 2*a*. The key motion is transmitted through an action unit 2*b* to a hammer 2*c*, and the hammer 2*c* is brought into collision with a string 2*d*. The hammer 2*c* gives rise to vibrations of the string 2*d*, and sound waves, which express a tone, are propagated from the vibrating string 2*d* to the microphone 4. The portable tuning device 1 accomplishes at least two tasks, i.e., determines the pitch name of a tone, and visualizes the phase difference between the target pitch and the actual pitch of the tone during the tuning work.

In order to make the tasks reliable, the portable tuning device 1 further accomplishes a task to determine difference between a design frequency and an actual frequency of the audio clock signal before the tuning work.

The data processing system 1*b* is connected to the touch-panel display device 3, and is further connected to the microphone 4 through the jack (not shown) and connecting cable 4*a*. The touch-panel display device 3 serves as a man-machine interface so that users are communicable with the data processing system 1*b* through the touch-panel display device 3. In this instance, a liquid crystal display panel and a transparent conductive film form in combination the touch-panel display device 3. The sound waves are converted to an analog audio signal through the microphone 4, and the audio signal is supplied to the data processing system 1*b*.

Figure 2:
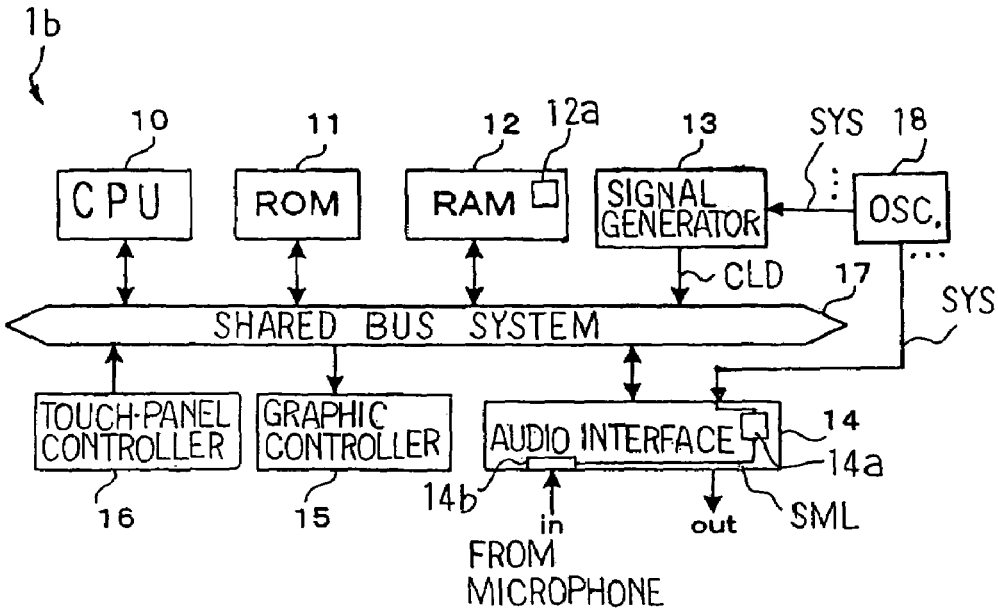
FIG. 2 is a block diagram showing the system configuration of an electric system incorporated in the tuning device.

As shown in FIG. 2, the data processing system 1*b* includes a central processing unit 10, which is abbreviated as "CPU", a read only memory 11, which is abbreviated as "ROM", a random access memory 12, which is abbreviated as "RAM", a signal generator 13, an audio interface 14, a graphic controller 15, touch-panel controller 16, a shared bus system 17 and an oscillator 18. The central processing unit 10, read only memory 11, random access memory 12, signal generator 13, audio interface 14, graphic controller 15 and touch-panel controller 16 are connected to the shared bus system 17 so that the central processing unit 10 is communicable with those system components 11, 12, 13, 14 and 15. The oscillator 18 produces a system clock signal SYS, and the system clock signal SYS is distributed to the system components 10 to 16 so as to establish good synchronization in the electric system 1*b*. The central processing unit 10, read only memory 11, random access memory 12 and a part of the shared bus system 16 may be integrated on a monolithic semiconductor chip as a microcomputer.

A computer program is stored in the read only memory 11, and the instruction codes, which form the computer program, are sequentially read out from the read only memory 11 to the shared bus system 17. The instruction codes thus read out onto the shared bus system 17 are fetched by the central processing unit 10, and are executed for accomplishing a given task. The computer program includes a main routine program and subroutine programs.

The central processing unit 10 is an origin of the data processing capability, and achieves jobs through the execution of the instruction codes. When a user supplies electric power to the data processing system 1*b*, the main routine program starts to run on the central processing unit 10. The central processing unit 10 firstly initializes the data processing system 1*b*, and waits for a user's instruction. Several jobs in the main routine program will be hereinlater described.

One of the subroutine programs is assigned to visualization of the difference between the actual frequency of a tone and the target frequency of the tone. When a user instructs the data processing system 1*b* to assist him or her in the tuning work on the upright piano 2, the main routine program starts to run on the central processing unit 10, and periodically branches to the subroutine program for the visualization. Another of the subroutine programs is assigned to estimation of the pitch name of a tone produced in the musical instrument, and the main routine program periodically branches to the subroutine program for the estimation of the pitch name. In this instance, the portable tuning device 1 estimates the actual pitch through an autocorrelation, and visualizes the frequency difference through renewal of a gradation image at intervals. The autocorrelation makes it possible to estimate the periodicity of an input periodic signal.

Yet another subroutine program is assigned to the determination of the frequency difference between the design frequency and the actual frequency of a sampling signal or an audio clock signal. In this instance, the subroutine program for the audio clock signal is executed during the system initialization.

The random access memory 12 offers a working area to the central processing unit 10. A digital audio signal or a series of audio data codes is accumulated in the random access memory 12 in the tuning work, and the central processing unit 10 examines the series of audio data codes to see how many frequencies the analog audio signal is assumed to have and whether or not a tone, which is expressed by the series of audio data codes, has an actual pitch equal to a target pitch. A memory space is assigned to a timer 12*a*, and the central processing unit 10 periodically increments the timer 12*a* in the subroutine program for determining the difference between the design frequency and the actual frequency of the audio clock signal.

The signal generator 13 includes a counter, which is responsive to the system clock SYS for producing a calendar clock signal CLD or a real time clock signal. In this instance, the calendar clock signal CLD serves as a reference signal. The calendar clock signal CLD makes the timer 12*a* incremented at regular intervals. The calendar clock signal CLD is well known to persons skilled in the art, and is found in the general-purpose information processing devices such as, for example, personal computer systems, personal digital assistants and the likes. The date i.e., year, month, day and time is periodically renewed with the calendar clock signal CLD. The calendar clock signal CLD is as accurate as a quartz clock, and the error is of the order of ±15 seconds per month. In this instance, the calendar clock signal CLD serves as a reference signal.

The audio interface 14 is provided with a signal input unit "in", a signal output unit "out" and a frequency demultiplier 14*a*. The frequency demultiplier 14*a* is connected to the oscillator 18, and produces the audio clock signal SML or sampling signal from the system clock SYS. In this instance, the audio clock signal SML is designed to have the frequency at 44.1 kilo-hertz. In other words, the design frequency is 44.1 kilo-hertz. However, the frequency demultiplier 14*a* is less accurate rather than the counter 13*a*. The actual frequency is permitted to be deviated from the design frequency by 1 cent to 10 cents as described hereinbefore. This is because of the fact that standard PDAs usually include the high-precision counter 13*a* and the standard demultiplier 14*a* for the audio clock signal. The deviation or frequency difference is determined through the execution of the subroutine program during the initialization as will be described in more detail.

The signal input unit "in" is connected to the microphone 4 through the cable 4*a*, and includes an analog-to-digital converter 14*b*. The audio signal is supplied from the microphone 4 to the analog-to-digital converter 14*b*, and the analog-to-digital converter 14*b* samples discrete values on the audio signal in synchronism with the audio clock signal SML so as to produce a series of audio data codes. The central processing unit 10 periodically fetches the audio data codes from the audio interface 14, and accumulates the audio data codes in the random access memory 12.

On the other hand, the signal output unit "out" includes a digital-to-analog converter, and the digital-to-analog converter produces an analog signal from a series of digital codes in response to the audio clock signal SML.

The graphic controller 15 is connected to the liquid crystal display panel of the touch-panel display device 3. The graphic controller 15 produces visual images on the liquid crystal display panel under the supervision of the central processing unit 10. Visual images form pictures, and each picture appears on the liquid crystal display panel over a frame or frames. The images of the pictures will be hereinlater described in detail. The picture is changed to a new picture or maintained in the next frame. Standard personal digital assistants usually repeat the frames at 15 Hz to 20 Hz. The frame frequency is less than the pitch of the lowest tone produced through the upright piano 2.

The touch-panel controller 16 is connected to the transparent conductive film of the touch-panel display device 3, and cooperates with the graphic controller 15. The touch-panel controller 16 provides a coordinate on the visual images produced on the liquid crystal display panel. When a user pushes a part of the transparent conductive film overlapped with a visual image with a suitable tool such as, for example, a pen, the touch-panel controller 16 determines the visual image on the liquid crystal display panel. In case where the visual images express some instructions, the central processing unit 10 recognizes the user's instruction through the image or images specified by the touch-panel controller 16.

Figure 3:
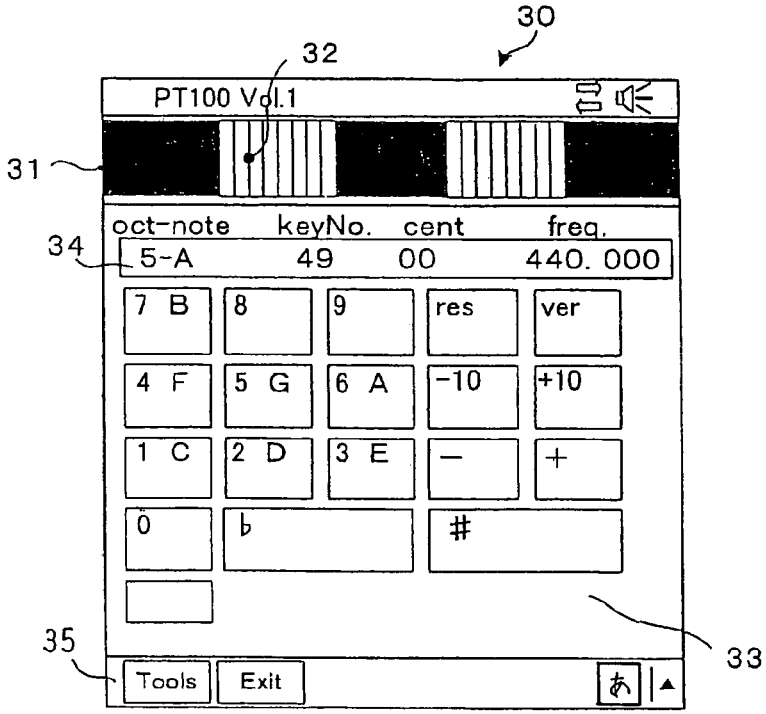
FIG. 3 is a front view showing a picture produced on a liquid crystal display panel of the tuning device.

FIG. 3 shows a picture 30 produced on the touch-panel display device 3. The picture 30 has at least four areas 31, 33, 34 and 35. The area 31 is assigned to a gradation image 32. A target waveform is representative of a target pitch or target frequency to which the musical instrument is to be tuned, and an actual waveform is found on the analog audio signal. An actual signal period or an actual repetition period is determined on the basis of the actual waveform, and the repetition period is the inverse of the actual frequency. In case where the actual waveform of the analog audio signal has a repetition period equal to that of a target waveform, the gradation pattern 32 is stable in the area 31, and the user finds the gradation image not to be moved in the area 31. On the other hand, if the difference takes place between the actual waveform and the target waveform, the user finds the gradation image 32 to be sideward moved across the area 31.

The areas 33 and 35 are assigned to images of button switches. "7B", "8", "9", "res", "ver", "4F", "5G", "6A", "−10", "+10", "1C", "2D", "3E", "−", "+", "0", "b" and "#" are enclosed with rectangles, which express the peripheries of the button switches. The button switches "7B", "4F", "5G", "6A", "1C", "2D" and "3E" are shared between the numerals "7", "4", "5", "6", "1", "2" and "3" and the alphabets "B", "F", "G", "A", "C", "D" and "E". The alphabets express pitch names. Users specify a pitch name and an octave by pressing the button switches with the tool. When a user pushes the image of button switch "Tools", a job list is displayed on the entire area instead of the picture 30 shown in FIG. 3.

The area 34 is assigned to pieces of tuning information. Abbreviations "oct-note", "keyNo.", "cent" and "freq" are labeled with four sub-areas in the rectangle. The abbreviations "oct-note", "keyNo.", "cent" and "freq." and visual images produced below the abbreviations are hereinafter described in detail.

The visual images below the abbreviation "oct-note" express a pitch name assigned the tone to be targeted and an octave where the tone belongs. The visual image "5-A" means that the tone to be targeted is A in the fifth octave. The central processing unit 10 determines the pitch name and octave through execution of a subroutine program, and informs the user of the pitch name and octave through the visual images in the sub-areas below the abbreviation "oct-note".

The visual image below the abbreviation "keyNo." expresses the key number assigned the key at "5-A". The upright piano 2 has eighty-eight black and white keys 2*a*, and the key numbers "1" to "88" are assigned to the eighty-eight black and white keys 2*a*. The pitch name A in the fifth octaves is assigned to the key with the key number "49".

The visual image below the abbreviation "cent" expresses the interval between two tones. As well know to the persons skilled in the art, a whole tone in the temperament is equivalent to 200 cents, and, accordingly, the semitone is equivalent to 100 cents. When a user wishes to specify a tone offset from the tone "5-A" by a quarter tone, he or she inputs "50" cents through the visual images of button switches. When the visual images of "00" is produced in the sub-area below "cent" as those in FIG. 3, the tone is to be found just at A in the fifth octave.

The visual images below the abbreviation "freq." express the target frequency corresponding to the target pitch to which the musical instrument is to be tuned during data input by a user. A frequency, which is corresponding to the designated pitch name, is to be modified with the interval "cent" for the target pitch "freq.". In FIG. 3, numeral images "440.00" is read in the sub-area under the abbreviation "freq." together with the pitch name "5-A" and interval "00". This means that the tone "A" in the fifth octave, which is produced through the musical instrument 2, is to be found at 440.00 hertz. Though not shown in the drawings, while the portable tuning device 1 is assisting the user in the tuning work on the upright piano 2, the portable tuning device 1 can estimate the target frequency of a tone produced in the upright piano 2 without user's designation, and produces a visual image of the target frequency Hz.

At the beginning of the tuning work, a user may specify a value of the target pitch through the data input for the standard pitch, pitch name, octave and interval through the manipulation on the images of button switches. As described hereinlater in detail, the portable tuning device 1 can estimate the tone at a corresponding pitch. In case where the portable tuning device 1 determines the pitch name on the basis of the estimated pitch, the user inputs only the standard pitch and interval.

In both cases, the central processing unit 10 causes the graphic controller 15 to produce the visual images expressing the pitch name, octave and interval in cent below the abbreviations "oct-note" and "cent". The central processing unit 10 determines the key number on the basis of the pitch name and octave, and further determines the fundamental frequency on the basis of the pitch name, octave and interval. The fundamental frequency features the tone assigned the target pitch name, and serves as the target pitch in this instance.

In order quickly to determine the key number and frequency, the pitch names in several octaves, key number assigned to the black and white keys of a standard piano and values of fundamental frequency are correlated with one another for several values of the standard pitch in the read only memory 11. When a user inputs a value of the standard pitch, a pitch name and an octave through the touch-panel liquid crystal display device 3, the central processing unit 10 determines the pitch name in the given octave on the basis of the coordinates reported from the touch-panel controller 16, and accesses a table, which is assigned to the designated standard pitch, in the read only memory 11 with the pitch name in the given octave. Then, the fundamental frequency and key number are read out from the read only memory 12 to the central processing unit 10. The central processing unit 10 supplies pieces of visual data expressing the pitch name, octave, key number and target frequency to the graphic controller 15, and the visual images are produced in the area 34 under the control of the graphic controller 15.

If the user further inputs the interval from the tone assigned the pitch name, the visual image of which is presently produced in the area 34, the touch-panel controller 16 reports the coordinate of the visual image of button switch pushed by the user to the central processing unit 10, and the central processing unit 10 converts the interval from the cent to the hertz. The central processing unit 10 adds the interval expressed in hertz to the fundamental frequency, and supplies the pieces of visual data expressing the new fundamental frequency to the graphic controller 15. The visual image of interval in cent and visual image of new fundamental frequency are produced in the area 34 under the control of the graphic controller 15.

While the sound waves are being propagated from the upright piano 2 to the portable tuning device 1, the portable tuning device 1 analyzes the analog audio signal for the phase difference between the actual frequency and the target frequency, and visualizes the phase difference on the touch-panel liquid crystal display device 3. If a user instructs the portable tuning device 1 to determine the pitch name, the portable tuning device 1 estimates the actual frequency of the tone through autocorrelation, and determines the target frequency of the tone. The portable tuning device 1 can inform the user of the target pitch name together with the phase difference through the visual images. Thus, the portable tuning device 1 according to the present invention assists the user in the tuning work through the visual images of the phase difference and the visual image of the target pitch name.

The portable tuning device 1 according to the present invention has two modes of operation, i.e., a manual mode and an automatic mode. When a user designates the target pitch name, the portable tuning device 1 enters the manual mode, and visualizes the phase difference between the actual frequency and the target frequency through a gradation image or images. On the other hand, when a user specifies the standard pitch and interval without any designation of pitch name, the portable tuning device 1 enters the automatic mode. The portable tuning device 1 determines the target pitch name and phase difference in the automatic mode, and visualizes them. Thus, the main routine program and subroutine program for visualization of phase difference are common to both manual and automatic modes. For this reason, description is firstly made on the main routine program and subroutine program for visualization of phase difference, and the subroutine program for estimation of target pitch is described after the description on the main routine program and subroutine program for the determination of phase difference.

While the main routine program is running on the central processing unit 10, the user inputs the standard pitch, pitch name "oct-note", interval "cent" and size of window W. The main routine program periodically branches to a subroutine program for visualizing the phase difference.

The subroutine program for visualization of phase difference expresses a method for producing the gradation image 32. Some terms are hereinafter defined for the method according to the present invention.

A "renewal period" is equivalent to the time period for keeping the gradation pattern in the area 31. In other words, when the renewal period is expired, the central processing unit 10 determines the gradation image 32 for the next renewal period. The renewal period is equal to a multiple of the repetition period of the target waveform.

A "window" W is a time period equal to a product between the inverse of a target frequency Hz and an arbitrary number called as "a window parameter, and is not longer than the renewal period. The user gives the window parameter to the portable tuning device 1 through the touch-panel liquid crystal display device 3. The inverse of target frequency Hz is labeled with "Hz'" in FIG. 4, and the window W is two and half times longer than the inverse Hz' of target frequency in the graph shown in the figure.

A "basic image" expresses a single period of the actual waveform of fundamental frequency component of the audio signal appearing in each window W, and a "polarity pattern" repeatedly takes place in the window W. The fundamental frequency component is equal to the actual frequency of the tone. The polarity pattern is constituted by a pair of negative potential region and positive potential region. A part of the polarity pattern, which expresses the negative potential region, and the remaining part of the polarity pattern, which expresses the positive potential region, are referred to as a "negative portion" and a "positive portion", respectively. When the fundamental frequency component of the audio signal changes the potential level from the negative to the positive, the polarity pattern starts. The positive portion continues through the rise of the audio signal and the decay of the audio signal, and is terminated at the potential change from the positive to the negative. On the other hand, when the fundamental frequency component of audio signal is changed to negative, the negative portion starts, and is continued until the potential change to the positive, again.

The portable tuning device 1 firstly samples discrete values on the audio signal for the renewal period, and accumulates the discrete values in the random access memory 12 as the pieces of audio data. The Subsequently, the fundamental frequency component or actual frequency is extracted from the discrete values, and pieces of fundamental frequency data, which express the fundamental frequency component or actual frequency, are accumulated in the random access memory 12. A series of pieces of fundamental frequency data are extracted from the accumulated pieces of fundamental frequency data for the window W.

The series of fundamental frequency data is converted to a series of polarity data. The pieces of polarity data express the positive potential region and negative potential region of the fundamental frequency component, and are stored in the random access memory 12. The series of polarity data expresses the basic image. The series of polarity data is transferred to the graphic controller 15, and the graphic controller 15 produces the gradation image 32 in the area 31. The graphic controller 15 keeps the gradation image 32 over the renewal period.

When the renewal period is expired, the central processing unit 10 restarts to accumulate the pieces of audio data in the random access memory 12. The accumulated pieces of audio data are processed as similar to those of the previous renewal period, and the central processing unit 10 determines a series of polarity data expressing the basic image, again. The series of polarity data is transferred to the graphic controller 15, and the gradation image 32 is renewed on the basis of the series of polarity data.

Figure 4:
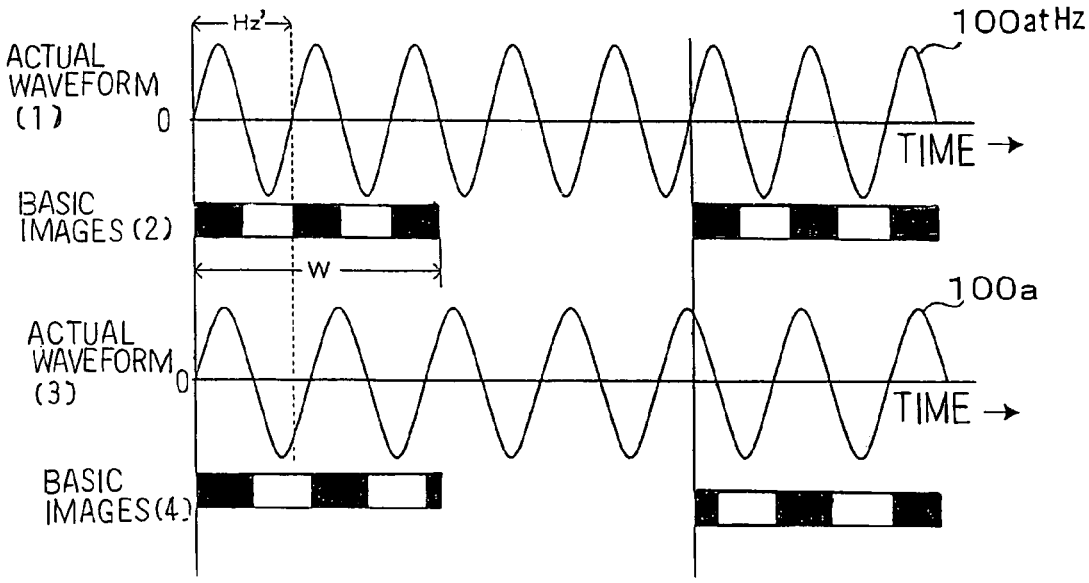
FIG. 4 is a diagram showing basic images in terms of audio waveforms different from each other.

The audio signal is assumed to have the repetition period Hz' equal to the repetition period of the target waveform. The actual waveform 100 of the fundamental frequency component crosses zero at the beginning and end of the window W as shown in FIG. 4, and two and half polarity patterns occupy the left window W. The two and half polarity patterns form the basic image (2) in the left renewal time period. Even though the time runs into the next renewal time period, the actual waveform 100 also crosses zero at the beginning and end of the next window W, and two and half polarity patterns occupy the next window W. Thus, the two and half polarity patterns repeatedly form the basic images (2). Although the gradation pattern 32 is renewed, the same basic images (2) are repeatedly produced in the area 31 as the gradation image 32. For this reason, the user finds the gradation image 32 stable in the area 31.

On the other hand, when the repetition period of actual waveform 100*a* is longer than the repletion period Hz' of the target waveform, the basic image (4) is changes from the window W to the next window W. When the basis images (4) are produced in the area 31 as the gradation image 32, the user finds the gradation image 32 flows across the area 31 in the lateral direction. Thus, the portable tuning device 1 notifies the user of the inconsistency of waveforms through the lateral movement of the gradation image 32.

Figure 6:
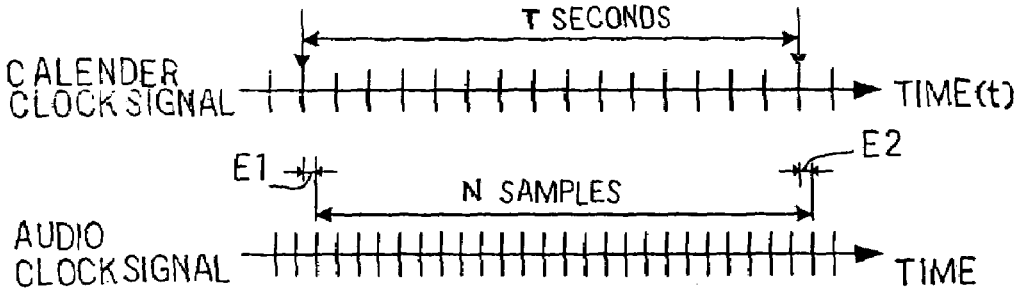
FIG. 6 is a graph showing relation between a calendar clock signal and an audio clock signal.

Description is hereinafter made on a method for determining the difference between the design frequency and the actual frequency with reference to FIGS. 5 and 6.

A user is assumed to instruct the central processing unit 10 to determine the difference between the design frequency and the actual frequency of the audio clock signal SML, i.e., deviation x from the design frequency through the touch-panel display device 3. Then, the main routine program branches to the subroutine program for determining the deviation x from the design frequency.

First, the central processing unit 10 instructs the audio interface 14 to start the analog-to-digital conversion as by step S1. The user pushes the image of the job on the touch-panel liquid crystal display device 3 with the tool. Then, the analog-to-digital converter 14*b* samples the potential level at the input terminal in response to the audio sampling clock SML, and the audio data codes are stored in the random access memory 12. Even if the plug 4*b* is not inserted into the socket of the audio interface 14, the analog-to-digital converter 14*b* produces the audio data codes.

Subsequently, the central processing unit 10 reads out the present time from the timer 12*a* as by step S2, and checks the present time to see whether or not the timer 12*a* has been just reset as by step S3. As described hereinbefore, the timer 12*a* increments the time in synchronism with the calendar clock signal CLD so that the present time is reliable. While the timer 12*a* is incrementing the time, the timer 12*a* is indicative of the time later than the previous time, and the answer is given negative "No". With the negative answer, the central processing unit 10 returns to step S2. Thus, the central processing unit 10 reiterates the loop consisting of steps S2 and S3 until the change of answer at step S3.

When the timer 12*a* is reset, the answer is changed to affirmative "Yes", and the central processing unit 10 proceeds to step S4. The timer 12*a* restarts to measure the time period T seconds as shown in FIG. 6, and periodically increments the time. Concurrently, the central processing unit 10 starts to count the number of audio data codes. Since the analog-to-digital converter 14*b* produces the audio data codes in synchronism with the audio clock signal SML, the number of audio data codes is equal to the number of audio clock pulses.

Subsequently, the central processing unit 10 reads out the lapse of time (t) from the timer 12*a* as by step S5, and determines whether or not the predetermined time period T is expired as by step S6. While the lapse of time (t) is shorter than the predetermined time period T, the answer at step S6 is given negative "No", and the central processing unit 10 returns to step S5. Thus, the central processing unit 10 reiterates the loop consisting of steps S5 and S6 until the predetermined time period T is expired.

When the lapse of time (t) is equal to the predetermined time period T, the answer at step S6 is changed to affirmative "Yes", and the central processing unit 10 proceeds to step S7. The central processing unit 10 determines the number of audio data codes or pieces of audio data, and stores the number N of audio data codes at step S7. Thus, the central processing unit 10 determines the number N of audio clock pulses in the predetermined time period T.

Subsequently, the central processing unit 10 calculates the deviation x or difference between the design frequency and the actual frequency for the audio clock signal SML as by step S8. In this instance, the predetermined time period T is assumed to be sixteen minutes, i.e., 960 seconds. The predetermined time period T will be hereinlater described in more detail.

The deviation x is expressed as $$x=(N/F)/T \qquad \text{Equation 1}$$

where T is the predetermined time period, N is the number of audio clock pulses in the predetermined time period N, and F is the design frequency of the audio clock signal SML such as, for example, 44.1 kHz or 22.05 kHz. The central processing unit 10 stores the deviation x at a certain memory location of the random access memory 12 as by step S9.

Various errors are not taken into consideration for the deviation x expressed by equation 1. Followings are the various errors:

(A) The difference between the design frequency and the actual frequency of the calendar clock signal CLD, (B) The read-out error on the calendar clock signal CLD, and (C) The time lags (E1+E2) at the beginning and end of the predetermined time period T.

When the errors A, B and C are taken into consideration, the deviation x' is expressed as $$x'=\{(N/F)+C\}/\{(1+A)T+B\} \qquad \text{Equation 2}$$

The present inventors confirmed that A, B and C were of the order of ±10 ppm, equal to or less than 0.1 second and equal to the single sampling period at the maximum, respectively. In case where the audio clock signal SML was produced at 22.05 kHz, the error C was equal to or less than 0.045 millisecond. If the audio clock signal SML oscillated at 44.1 kHz, the error C was equal to or less than 0.0225 millisecond.

If the difference between x and x' has serious influence on the tuning work, the central processing unit 10 calculates the deviation x' instead of the deviation x at step S8. An appropriate value of the predetermined time period T makes it possible to use equation 1 at step S8 regardless of the errors A, B and C.

As described hereinbefore, tuners are expected to tune acoustic pianos within 0.2 cent. If the difference between the deviation x and deviation x' is equal to or less than the allowable tuning error of 0.2 cent, it is possible to use equation 1 instead of equation 2. The deviations x and x' are inversely proportional to the predetermined time period T. If the predetermined time period T is long enough to make the difference (x'−x) shorter than the allowable tuning error, equation 1 is available for the calculation at step S8. In case where the tuning work is carried on the acoustic pianos, the minimum time period T is not shorter than 15 minutes, the difference (x'−x) is ignoreable. For this reason, the predetermined time period T is adjusted to 16 minutes in the above-described embodiment.

Figure 7A:
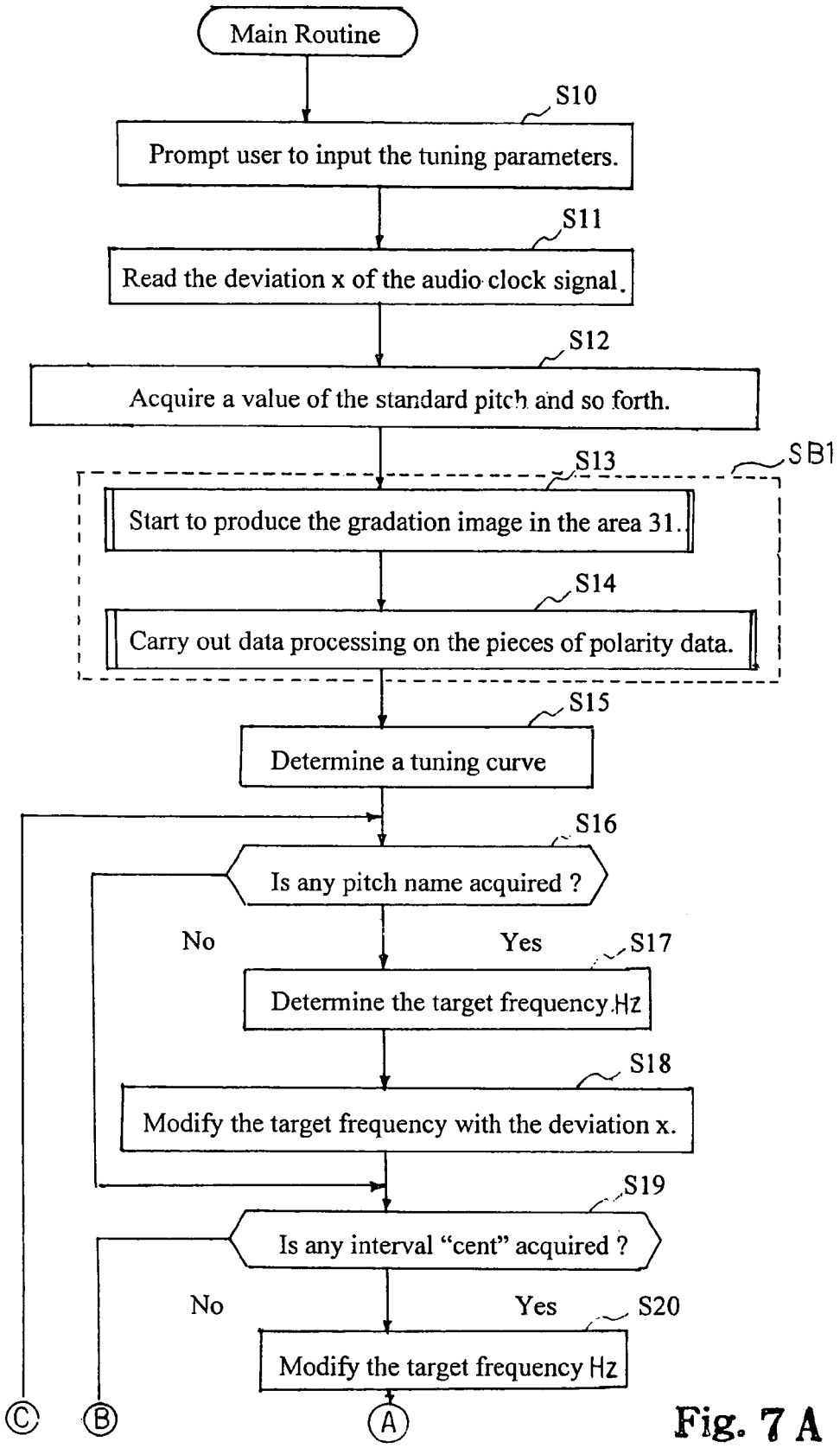
FIGS. 7A and 7B are flowcharts showing a part of a main routine program.
Figure 7B:
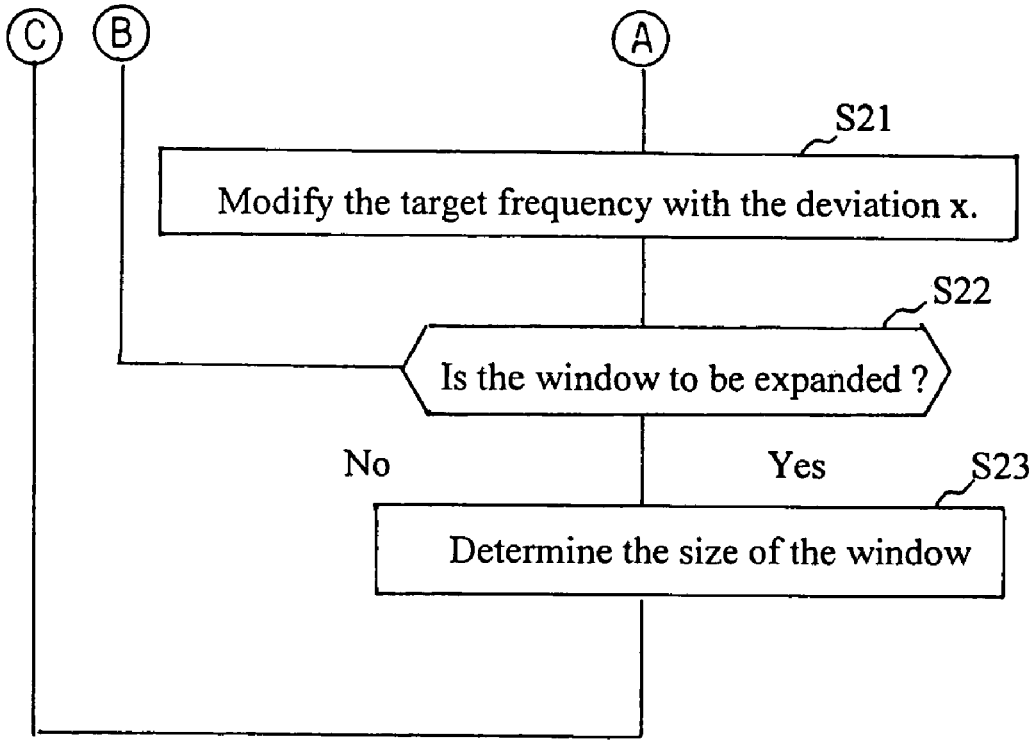
Figure 8:
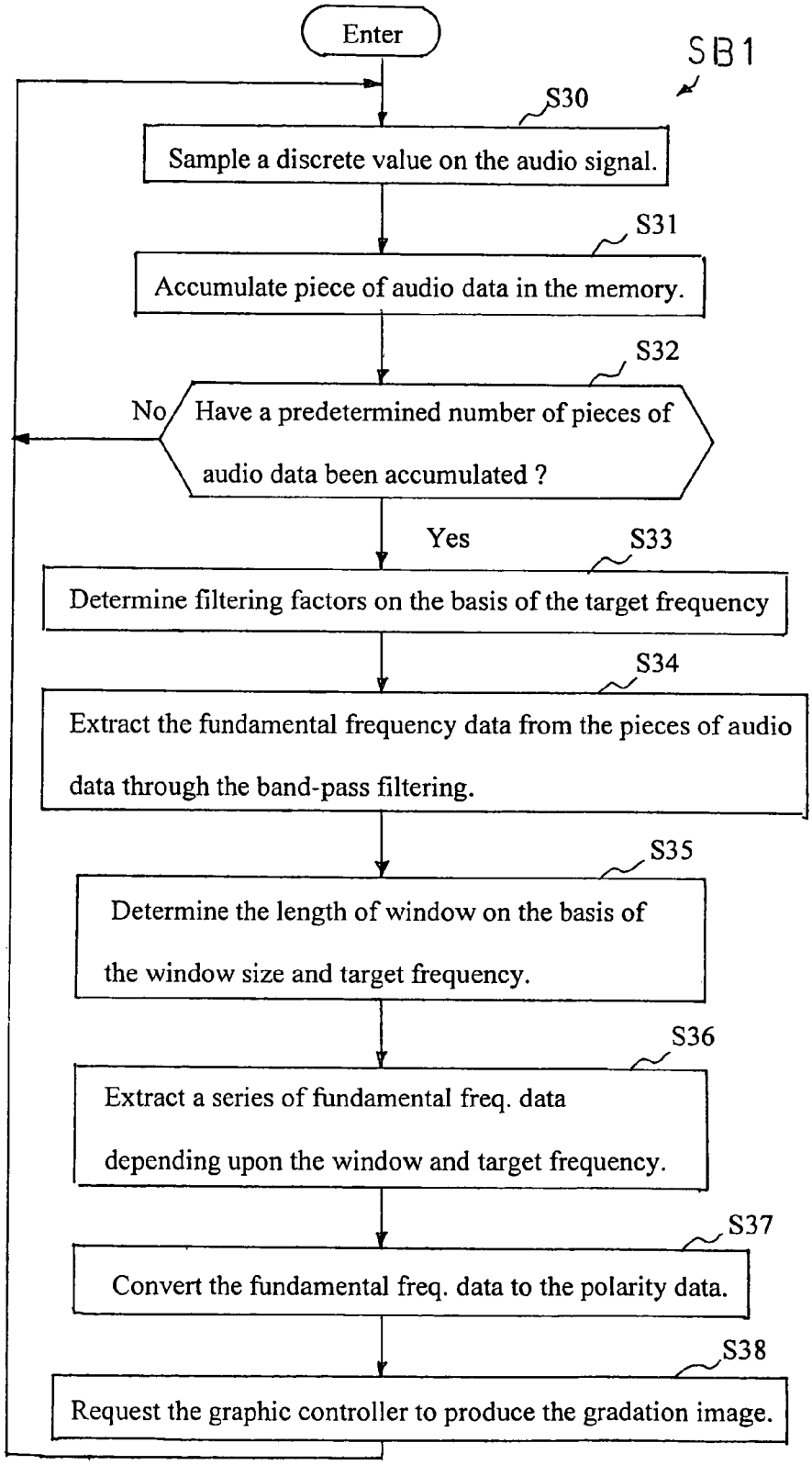
FIG. 8 is a flowchart showing a subroutine program for a tuning work.

The target pitch of tones is to be modified with the deviation x during the tuning work as will be hereinafter described in detail. The assistance in tuning work is realized through execution of jobs in the computer program. The computer program is broken down into the main routine program and subroutine programs as described hereinbefore. While the main routine program is running on the central processing unit 10, the portable tuning device 1 communicates with a user for jobs to be carried out, and adjusts itself to the conditions given by the user. FIGS. 7A and 7B show a part of the main routine program relating to the tuning work on the upright piano 2, and the target frequency Hz is modified with the deviation x already stored in the random access memory 12. One of the subroutine programs SB1 is assigned to the visualization of phase difference, i.e., the production of the gradation images 32*a*/32*b*, and is illustrated in FIG. 8. The main routine program and subroutine program SB1 are hereinafter described with reference to FIGS. 7A, 7B and 8.

The main routine program periodically branches to the subroutine program SB1, and the central processing unit 10 repeatedly produces the gradation images for the renewal time periods. Although the subroutine program SB1 is inserted between step 12 and step 15 of the main routine program, the main routine program branches to the subroutine program SB1 at every timer interruption regardless of the job in the main routine program.

A user is assumed to turn on the power switch of the portable tuning device 1. The central processing unit 10 initializes the data processing system 1*b*, and sets default values on tuning parameters as by step S10. One of the tuning parameters is a value of the standard pitch. The standard pitch is a frequency at A to which all the musical instrument and singers participating in an ensemble are to be tuned. There have been proposed several values for the standard pitch such as 440 hertz, 442 hertz, 439 hertz and so forth. In this instance, the default value of standard pitch is 440 hertz. Other tuning parameters are the pitch name, interval in cent and window size W, and zero cent and 2.5 times are the default values of the interval and window size W. A default tuning curve is further transferred from the read only memory 11 to the random access memory 12. The tuning curve will be described in conjunction with jobs at step S15.

Subsequently, the central processing unit 10 accesses the random access memory 12, and reads out the deviation x into an internal register as by step S11.

Subsequently, the central processing unit 10 requests the graphic controller 15 sequentially to produce prompt messages to the user on the touch-panel liquid crystal display device 3. The touch-panel controller 16 informs the central processing unit 10 of the coordinates of the areas pushed by the user, and the central processing unit 10 determines user's instruction, values and options.

In detail, the graphic controller 15 produces the numeral images of the candidates of the standard pitch. If the user pushes one of the numeral images with the tool, the central processing unit 10 changes the standard pitch from the default value to the value selected by the user. In this instance, the user is assumed not to change the standard pitch so that the standard pitch is fixed to the default value of "440.000 hertz".

Upon completion of the jobs at step S12, the main routine program gets ready to branch to the subroutine program SB1, and the graphic controller 15 produces the gradation image in the area 31 through the execution at steps S13 and S14. The jobs at steps S3 and S4 are hereinlater described with reference to FIG. 8.

Subsequently, the central processing unit 10 cooperates with the graphic controller 15 and touch-panel controller 16 for the tuning curve as by step S15. The term "tuning curve" means plots indicative of relation between pitch name and target frequency Hz. Plural tuning curves are stored in the read only memory 11 in the form of table. The plural tuning curves or tables express preferable relation between the pitch name and the target frequency for different types of piano such as, for example, the grand piano and upright piano. Different tuning curves may be respectively assigned to plural models of the grand piano/upright piano. This is because of the fact that musicians feel tones in the higher register natural at certain values of frequency higher than the standard values of frequency in the temperament. The certain values are varied depending upon the type and model of piano. For this reason, the plural tuning curves are prepared for the piano. One of the tuning curves serves as the default tuning curve so that the default tuning curve is employed for the tuning work under the condition that the user does not select another tuning curve. The graphic controller 15 produces images indicative of the plural tuning curve for different types of piano. When the user pushes an area assigned to one of the tuning curves, the touch-panel controller 16 informs the central processing unit 10 of the coordinates of the area, and the central processing unit 10 determines the tuning curve selected by the user. The selected tuning curve is transferred from the read only memory 11 to the random access memory 12, and the default tuning curve is replaced with the selected tuning curve.

Subsequently, the central processing unit 10 requests the graphic controller 14 to produce a prompt message, which prompts the user to input a pitch name, and waits for a time. While the prompt message is displaying on the touch-panel liquid crystal display device 3 for the predetermined time period, the central processing unit 10 repeatedly determines whether or not the user inputs a pitch name as by step S16. When the user pushes an area of a pitch name and an area of an octave, the touch-panel controller 16 informs the central processing unit 10 of the coordinates of the areas so that the answer at step S16 is given affirmative "Yes". Then, the central processing unit 10 determines the target frequency Hz for the pitch name on the basis of the tuning curve as by step S17.

Upon determination of the target frequency Hz, the central processing unit 10 modifies the target frequency Hz with the deviation x as by step S18. The deviation x is assumed to be found in the audio clock signal SML. If the deviation x has been determined to be δ cent higher, the deviation x has influence on the number of audio data codes accumulated in the random access memory 12, and makes the measured frequency of audio clock signal SML lower than the true frequency by δ cent. For this reason, the target frequency Hz is corrected as $$Hz=f\times 2^{-(\delta/1200)} \qquad \text{Equation 3}$$

where f is the target frequency without any deviation x.

On the other hand, if the deviation x has been determined to be δ cent lower, the target frequency Hz is corrected as $$Hz=f\times 2^{(\delta/1200)} \qquad \text{Equation 4}$$

Upon completion of the modification, the central processing unit 10 writes the target frequency Hz, which has been already modified with the deviation x, together with the pitch name in the random access memory 12. If the time period is expired without any input of pitch name, the answer at step S16 is given negative "No", and the central processing unit 10 proceeds to step S19 without any execution at steps S17 and S18.

The central processing unit 10 requests the graphic controller 15 to prompt the user to input the interval in cent, and waits for a time to see whether or not the user inputs the interval at step S19. When the user inputs the interval in cent, the answer at step S19 is given affirmative 'Yes", and the central processing unit 10 shifts the target frequency Hz from the value on the turning curve by the given cent value as by step S20. Thereafter, the central processing unit 10 modifies the target frequency Hz, which has been already modified with the cent value, with the deviation by using equation 3 or 4 as by step S21.

If, on the other hand, the predetermined time period is expired without any data input, the answer at step S19 is given negative "No", and the central processing unit 10 proceeds to step S22 without any execution at steps S20 and S21.

At step S22, the central processing unit 10 determines whether or not the user changes the window size W. The graphic controller 15 produces the prompt message, and the touch-panel controller 16 checks the touch panel to see whether the user inputs an ordinary size or a large size. When the user does not instruct the central processing unit 10 of the large window size for a predetermined time period, the central processing unit 10 keeps the default size, i.e., the ordinary size, which is two and half times longer than the inverse Hz' of the target frequency Hz, and returns to step S16. When the user pushes the image of ordinary window size in the predetermined time period, the touch-panel controller 16 informs the central processing unit 10 of the coordinate of the area assigned the image of ordinary size, and the central processing unit 10 immediately returns to step S16 without expiry of the predetermined time period.

If, on the other hand, the user pushes the area assigned to the image of large window size, the touch-panel controller 16 informs the coordinate of the pushed area, and the central processing unit 10 is noticed that the user selects the large window size. Then, the answer at step S22 is given affirmative "Yes", and the central processing unit 10 rewrites the random access memory 12 from the ordinary size to the large size as by step S23. Upon completion of the jobs at step S23, the central processing unit 10 returns to step S16.

The user may firstly tune the piano 2 to the target frequency Hz at the default window size W. However, the user may wish precisely to tune the piano 2 to the target frequency Hz. Then, the user enlarges the window size W. The central processing unit 10 magnifies the gradation image 32 in the area 31, and makes the user recognize delicate difference from the target frequency Hz. With the assistance of the enlarged gradation image 32, the user can precisely tune the piano 2 to the target pitch Hz.

As will be understood, the central processing unit 10 reiterates the loop consisting of steps S16 to S23, and the portable tuning device 1 assists the user precisely to tune the piano 2. When the user changes the pitch name, the portable tuning device carries out the tuning work on the upright piano 2 at the new pitch name through the subroutine program SB1.

In this instance, the portable tuning device is implemented by a PDA (Personal Digital Assistants). Images on the touch-panel liquid crystal display are renewed at 15 to 20 hertz in the standard PDA. Accordingly, the main routine program branches to the subroutine program SB1 at intervals of 15 to 20 hertz.

The main routine program is assumed to branch to the subroutine program SB1. A job sequence is illustrated in FIG. 8. While the microphone 4 is supplying the audio signal to the audio interface 14, the analog-to-digital converter 14*a* periodically samples discrete values on the audio signal, and the discrete value is fetched by the central processing unit 10 as by step S30. The central processing unit 10 transfers a piece of audio data, which expresses the discrete value, to the random access memory 12 so as to accumulate the piece of audio data in the random access memory 12 as by step S31.

The central processing unit 10 checks the random access memory 12 to see whether or not a predetermined number of pieces of audio data are found in the random access memory 12 as by step S32. In this instance, the predetermined number is fallen within the range between 1024 and 2048. As described hereinbefore, the deviation x has been already determined, and the actual frequency of the audio clock signal is known to the central processing unit 10. For this reason, it is possible exactly to process the pieces of audio data. While the pieces of audio data are being increased toward the predetermined number, the answer at step S32 is given negative "No", and the central processing unit 10 repeatedly returns to step S30. Thus, the central processing unit 10 reiterates the loop consisting of steps S30 to S32 for increasing the pieces of audio data accumulated in the random access memory 12.

When the pieces of audio data reach the predetermined number, the answer at step S32 is changed to affirmative "Yes". With the positive answer "Yes", the central processing unit 10 determines filtering factors on the basis of the modified target frequency Hz as by step S33. The filtering factors define the filtering characteristics of a band-pass filter. The bandwidth and center frequency serve as the filtering factors.

Subsequently, the band-pass filtering is carried out on the pieces of audio data so that the fundamental frequency component, which is expressed by pieces of fundamental frequency data, is extracted from the pieces of audio data as by step S34. In other words, the harmonics and noise are eliminated from the pieces of audio data. The pieces of fundamental frequency data are stored in the random access memory 12. The target frequency Hz has been already modified with the deviation x at step S18 or S21 so that the central processing unit 10 can exactly determine the filtering factors.

Subsequently, the central processing unit 10 reads out the size of window W from the random access memory 12, and calculates the length of window. As described hereinbefore, the user has inputted the ordinary size, i.e., 2.5 times. The central processing unit 10 reads out the target frequency Hz and the size W from the random access memory 12. The central processing unit 10 determines the inverse Hz' of the target frequency Hz, and multiplies the inverse Hz' by 2.5. Thus, the central processing unit 10 sets the window to (Hz'× 2.5) as by step S35. The length of window is also free from the difference between the actual frequency and the target frequency of the audio clock signal SML.

Subsequently, the central processing unit 10 extracts a series of fundamental frequency data from the pieces of fundamental frequency data already stored in the random access memory 12 for the renewal time period as by step S36. The series of fundamental frequency data is adapted to occupy the window. In other words, the length of window is equal to the product between the number of pieces of fundamental frequency data and the sampling period.

Subsequently, the series of fundamental frequency data is converted to a series of polarity data as by step S37. As described hereinbefore, if certain pieces of fundamental frequency data have positive numbers, the certain pieces of fundamental frequency data are replaced with pieces of polarity data expressing binary number "1". On the other hand, if pieces of fundamental frequency data have negative numbers, the pieces of fundamental frequency data are replaced with pieces of polarity data expressing binary number "0". As a result, a bit string is left in the random access memory 12.

The bit string expresses the gradation data. The central processing unit 10 transfers the pieces of gradation data to the graphic controller 15, and requests the graphic controller 15 to produce the gradation image 32 in the area 31 of the touch-panel liquid crystal display device 3 as by step S38. Thus, the gradation image 32 is produced in the area 31.

The central processing unit 10 repeats the jobs at steps S30 to S38 so that the gradation image 32 is renewed at 15 to 20 hertz. If the audio signal expresses the target pitch of tone, the user sees the gradation image 32 as if it stops in the area 31. If, on the other hand, the actual pitch is different from the target pitch, the user sees the gradation image 32 as if it flows in the lateral direction. Thus, the user confirms the pitch of the tone through the movement of the gradation image 32.

As will be understood from the foregoing description, the tuning work is carried out on the basis of the target pitch Hz modified with the deviation x. This feature is desirable, because the musical instrument is accurately tuned.

Moreover, an existing periodical signal, which has been produced in the general-purpose information processing device, is used as the reference signal in the embodiment described hereinbefore. This feature is desirable, because any new high-precision oscillator is not required for the computer program of the present invention.

Second Embodiment

Figure 9A:
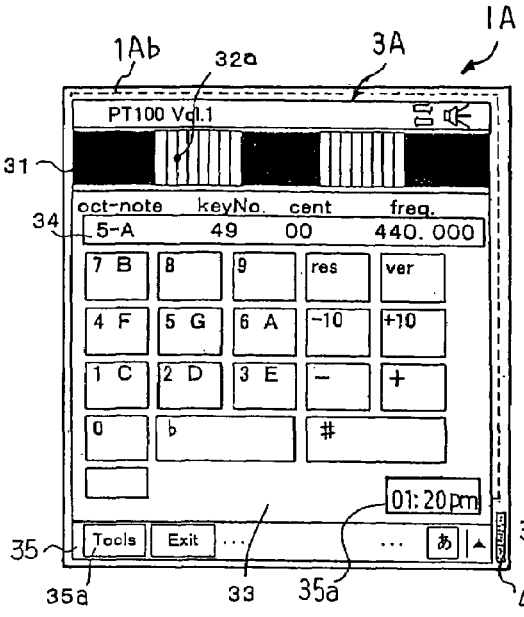
FIGS. 9A and 9B are front views showing another tuning device of the present invention.
Figure 9B:
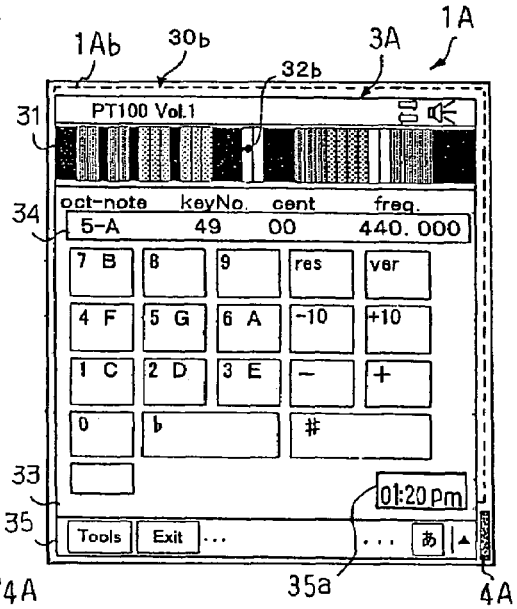
Figure 1:
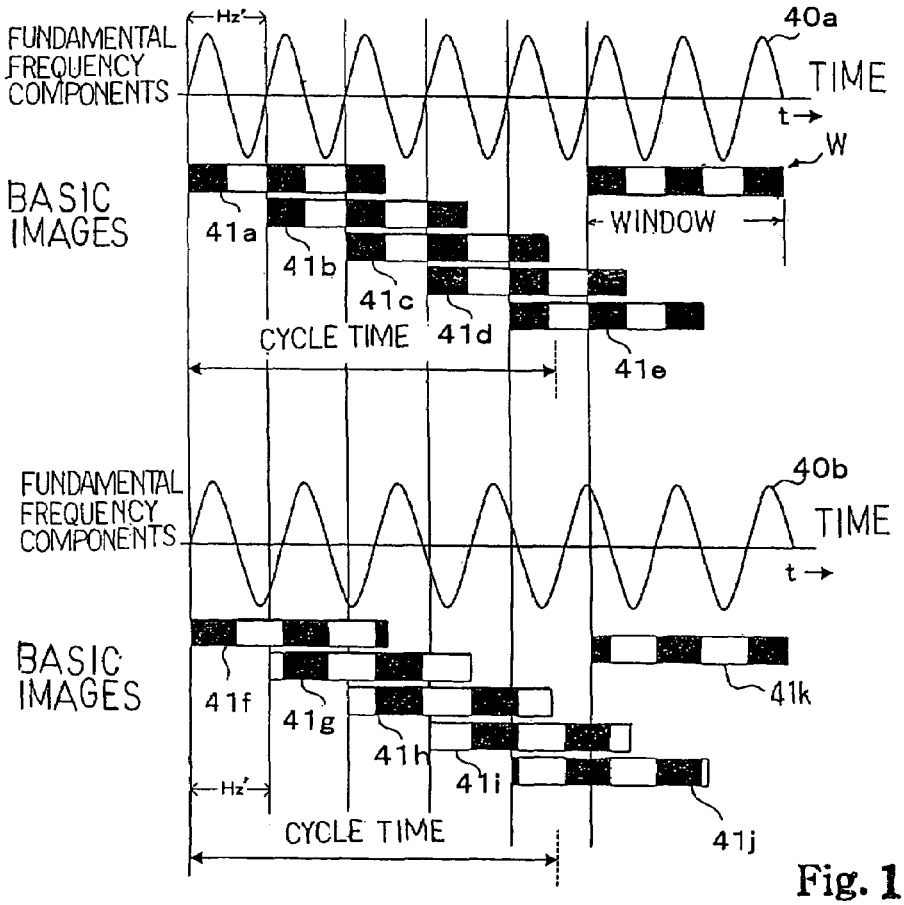

Turning to FIGS. 9A and 9B, another tuning device 1A embodying the present invention is implemented by a PDA, and largely comprises a data processing system 1Ab, a touch-panel liquid crystal display device 3A and a built-in microphone 4A. The data processing system 1Ab and touch-panel liquid crystal display device 3A are similar to the data processing system 1*b* and touch-panel liquid crystal display device 3 except for a clock window 35*a* so that description thereon is omitted for the sake of simplicity. In the clock window 35*a*, images of time and date are produced through execution of a subroutine program to which the main routine program periodically branches. The images of time and date are incremented by using the calendar clock signal CLD. The system components of the data processing system 1Ab and images on the touch-panel liquid crystal display device 3A are labeled with the references designating the corresponding system components and images described in conjunction with the first embodiment.

A computer program runs on the central processing unit 10, and the tuning device 1A accomplishes the tasks given by users through the execution of the computer program. The computer program is also broken down into a main routine program and subroutine programs. The main routine program and subroutine program for the determination of deviation x are similar to those shown in FIGS. 5, 7A and 7B. However, a subroutine program for producing a gradation image is different from that shown in FIG. 8. For this reason, description is focused on a method implemented by the subroutine program. In this instance, a two-tone gradation image 32*a* and more-than-two tone gradation images are selectively produced through the subroutine program. The two-tone gradation image 32*a* expresses consistency between the actual pitch to a tone and the target pitch, and is shown in FIG. 9A. On the other hand, the more-than-two-tone gradation images express inconsistency between the actual pitch and the target pitch, and one of the more-than-two-tone gradation images 32*b* is shown in FIG. 9B.

Description is hereinafter made on how the gradation images 32*a* and 32*b* are selectively produced on the area 31 with reference to FIG. 10. In the following description, term "cycle time" is defined as a time period exhibiting the gradation image 32*a* or 32*b*, and a user is assumed to tune an upright piano with the assistance of the tuning device 1A.

Assuming now that a user inputs pitch name of "A" in the fifth octave by selectively pushing the images of button switches in the area 33, the central processing unit 10 acknowledges the manual mode, and determines that the target pitch is 440.00 hertz. The user is assumed not to input the offset or interval from the target pitch. The central processing unit 10 requests the graphic controller 14 to produce the visual images "5-A", "49", "00" and "440.00" in the area 34 as shown in FIGS. 9A and 9B. The target frequency Hz is modified with the deviation x during the execution at step S18.

When the user depresses the key assigned the key number of 49, the piano tone is produced inside the upright piano, and the sound waves, which express the piano tone, are propagated to the built-in microphone 4A. The sound waves are converted to the audio signal by means of the built-in microphone 4A, and the audio signal is transferred to the audio interface 14.

The audio signal is sampled at regular intervals, which is much shorter than the inverse Hz' of target frequency, and the fundamental frequency component is extracted from the discrete values on the audio signal. The pieces of fundamental frequency data, which express the fundamental frequency component, are accumulated in the random access memory 12. The fundamental frequency component is representative of the actual frequency of the fundamental frequency of audio signal, and expresses the waveform labeled with 40*a* or 40*b* in FIG. 10.

Plural series of pieces of fundamental frequency data are extracted from the accumulated pieces of fundamental frequency data 40*a* or 40*b*. The delay time, which is equal to the inverse Hz' of target frequency, is introduced between each of the plural series of pieces of fundamental frequency data and the next series of pieces of fundamental frequency data.

The plural series of fundamental frequency data are converted to plural series of polarity data. In this instance, the positive discrete values and negative discrete values are replaced with "1" and "0", respectively. A bit string "1" expresses the positive portion of the polarity pattern, and is colored in black in FIG. 10. On the other hand, a bit string "0" expresses the negative portion of the polarity pattern, and is colored in white in FIG. 10. The single signal waveform of the fundamental frequency component 40*a*/40*b* of audio signal forms a pair of positive portion and negative portion so that the pieces of polarity data are expressed as pairs of positive and negative portions.

Since the window is two and half times longer than the inverse Hz' of target frequency, the central processing unit 10 extracts the plural series of pieces of polarity data for the windows, respectively, and the plural series of pieces of polarity data express the basic images 41*a*, 41*b*, 41*c*, 41*d*, 41*e*, . . . or 41*f*, 41*g*, 41*h*, 41*i*, . . . . The delay time, which is equal to the inverse Hz' of target frequency, is introduced between the adjacent two series of pieces of polarity data so that the basic images 41*b*, 41*c*, 41*d*, 41*e*, . . . or 41*g*, 41*h*, 41*i*, 41*j*, . . . are offset from the previous series of polarity data 41*a*, 41*b*, 41*c*, 41*d*, . . . or 41*f*, 41*g*, 41*h*, 41*i* by the inverse Hz' of target frequency.

The fundamental frequency component of audio signal 40*a* swings the potential level at 440.00 hertz, which is equal to the target frequency, so that each signal waveform is equal in length to the inverse Hz' of target frequency. The positive portion is equal in length to half of the wavelength of the fundamental frequency component 40*a* of audio signal, and the negative portion is also equal to the other half of the wavelength of the fundamental frequency component 40*a* of audio signal. For this reason, the boundary between the positive portion and the negative portion is just aligned with the zero-cross point on the time base. Since the window is two and half times longer than the inverse Hz' of target frequency, the basic images 41*a*, 41*b*, 41*c*, 41*d*, 41*e*, . . . exactly occupy the windows, respectively. In other words, each of the basic images 41*a*, 41*b*, 41*c*, 41*d*, 41*e*, . . . is same as the other basic images 41*b*, 41*c*, 41*d*, 41*e*, . . . , 41*a*.

On the other hand, the fundamental frequency component 40*b* of audio signal has the wavelength longer than the inverse Hz' of target frequency so that each of the polarity patterns in the basic images 41*f*, 41*g*, 41*h*, 41*i*, 41*j* . . . becomes longer than the inverse Hz' of target frequency. The boundary between the positive portion and the negative portion is not aligned with the zero-cross point on the time base, and two and half polarity patterns can not occupy the single window. As a result, the ratio between the positive portion and the negative portion in each window is varied, and the boundary between the positive portion and the negative portion is moved together with time.

The central processing unit 10 compares the bit pattern of the series of pieces of polarity data with that of the other series of pieces of polarity data as if the images 41*a*, 41*b*, 41*c*, 41*d*, 41*e*, . . . or 41*f*, 41*g*, 41*h*, 41*i*, 41*j*, . . . are superimposed on one another.

When the upright piano 2 produces the sound waves equivalent to the fundamental frequency component 40*a* of audio signal, the basic images 41*a*, 41*b*, 41*c*, 41*d*, 41*e*, . . . have the boundaries between the positive portions and the negative portions aligned with the boundaries of the other basic images 41*b*, 41*c*, 41*d*, 41*e*, . . . , 41*a*, and the basic images 41*a*, 41*b*, 41*c*, 41*d* and 41*e* are formed into the gradation image 32*a* as shown in FIG. 9A. Although the graphic controller 14 repeatedly produces the gradation image 32*a* in the area 32*a* at the renewal timing under the control of the central processing unit 10, the gradation image 32*a* is same as that in the previous cycle times. Thus, the portable tuning device informs the user that the upright piano 2 has been correctly tuned at the key number 49.

On the other hand, if the upright piano 2 produces the sound waves equivalent to the fundamental frequency component 40*b* of audio signal, the fundamental frequency component 40*b* of audio signal has the signal period longer than the inverse Hz' of target frequency, and, accordingly, the polarity pattern for the fundamental frequency component 40*b* of audio signal becomes longer than that for the fundamental frequency component 40*a* of audio signal. The window is also two and half times longer than the inverse Hz' of target frequency is. As a result, two-odd polarity patterns occupy the window. The delay time is also introduced between the basic images 41*f*, 41*g*, 41*h*, 41*i*, 41*j*, . . . and the next basic images 41*g*, 41*h*, 41*i*, 41*j*, . . . . When the basic images 41*f*, 41*g*, 41*h*, 41*i*, 41*j*, . . . are superimposed on one another, the boundaries between the positive portions and the negative portions in the basic images 41*g*, 41*h*, 41*i*, 41*j*, . . . are offset from the boundaries between the positive portions and the negative portions in the basic images 41*f*, 41*g*, 41*h*, 41*i*, 41*j*, . . . by a short time. Parts of all the positive portions are overlapped with one another for producing black sections, and parts of all the negative portions are overlapped with one another for producing white sections. However, other parts of several positive portions are overlapped with parts of the negative-positions for producing gray sections. As a result, the basic images 41*f*, 41*g*, 41*h*, 41*i* and 41*j* are formed into the gradation image 32*b*. The gradation image 32*b* is constituted by more than two tones, and is discriminative from the gradation image 32*a*.

When the gradation image 32*b* is renewed, the basic images 41*f*, 41*g*, 41*h*, 41*i*, 41*j* are changed to different basic images 41*k*, . . . . Comparing the basic image 41*f* with the basic image 41*k*, it is understood that the boundaries between the positive portions and the negative portions are moved from the basic image 41*f* to the basic image 41*k*. For this reason, the user feels the gradation image 32*b* laterally moved in the area 31. While the graphic controller 14 is repeatedly producing the gradation image 32*b*, the user understands the difference from the target pitch through the movement of the gradation image 32*b*.

If the cycle time is equal to one of the common multiples between the signal period of the fundamental frequency component 40*b* of audio signal and the inverse Hz' of target frequency, the gradation images, which represent the difference from the target pitch, do not laterally flow in the area 31. However, more than two tones form the gradation images, which represent the difference from the target pitch. As a result, the user recognizes the difference from the target pitch. Thus, the user can determine whether the upright piano 2 has been tuned at the target pitches on the basis of the number of tones in the gradation images 32*a* and 32*b*.

Figure 11:
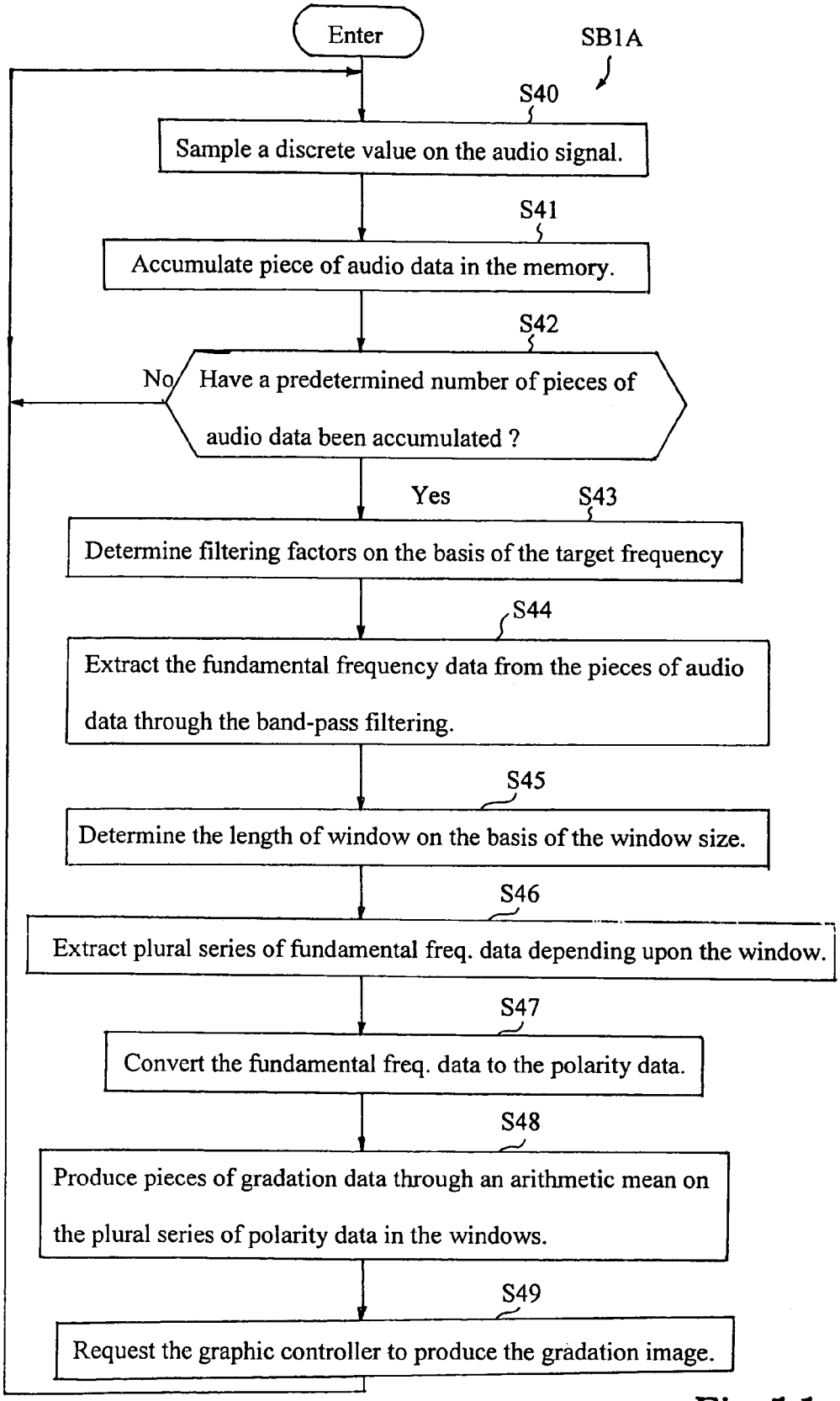
FIG. 11 is a flowchart showing a subroutine program for a tuning work in accordance with a second embodiment of the disclosure.

As described hereinbefore, the main routine program is same as the main routine program shown in FIGS. 7A and 7B. However, the subroutine program for visualizing the phrase difference is different from the subroutine program shown in FIG. 8, and is labeled with reference "SB1A" in FIG. 11.

The main routine program is assumed to branch the subroutine program SB1A. While the built-in microphone 4A is supplying the audio signal to the audio interface 14, the analog-to-digital converter 14*a* periodically samples a discrete value on the audio signal, and the discrete value is fetched by the central processing unit 10 as by step S40. In this instance, the sampling frequency is 44.1 kilo-hertz. The central processing unit 10 transfers a piece of audio data, which expresses the discrete value, to the random access memory 12 so as to accumulate the piece of audio data in the random access memory 12 as by step S41.

The central processing unit 10 checks the random access memory 12 to see whether or not a predetermined number of pieces of audio data are found in the random access memory 12 as by step S42. In this instance, the predetermined number is fallen within the range between 1024 and 2048. While the pieces of audio data are being increased toward the predetermined number, the answer at step S42 is given negative "No", and the central processing unit 10 returns to step S40. Thus, the central processing unit 10 reiterates the loop consisting of steps S40 to S42 for increasing the pieces of audio data.

When the pieces of audio data reach the predetermined number, the answer at step S42 is changed to affirmative "Yes". With the positive answer "Yes", the central processing unit 10 determines filtering factors on the basis of the target frequency Hz as by step S43. The filtering factors define the filtering characteristics of a band-pass filter. The bandwidth and center frequency serve as the filtering factors. Since the target frequency Hz has been already modified with the deviation x, the filtering factors are optimum to the band-path filter.

Subsequently, the band-pass filtering is carried out on the pieces of audio data so that the fundamental frequency component, which is expressed by pieces of fundamental frequency data, is extracted from the pieces of audio data as by step S44. In other words, the harmonics and noise are eliminated from the pieces of audio data. The pieces of fundamental frequency data are stored in the random access memory 12.

Subsequently, the central processing unit 10 reads out the size of window W from the random access memory 12, and calculates the length of window. As described hereinbefore, the user has inputted the ordinary size, i.e., 2.5 times. The central processing unit 10 reads out the target frequency Hz and the size W from the random access memory 12. The central processing unit 10 determines the inverse Hz' of the target frequency Hz, and multiplies the inverse Hz' by 2.5. Thus, the central processing unit 10 sets the window to (Hz'× 2.5) as by step S45.

Subsequently, the central processing unit 10 extracts plural series of fundamental frequency data from the pieces of fundamental frequency data already stored in the random access memory 12 for the cycle time as by step S46. Each series of fundamental frequency data is adapted to occupy one of the windows. In other words, the length of window is equal to the product between the number of pieces of fundamental frequency data in each series and the sampling period. The time delay is introduced between the first piece of fundamental frequency data of each series and the first piece of fundamental frequency data of the next series, and is equal to the inverse Hz' of target frequency.

Subsequently, the plural series of fundamental frequency data are respectively converted to plural series of polarity data as by step S47. As described hereinbefore, if pieces of fundamental frequency data have positive numbers, the pieces of fundamental frequency data are replaced with pieces of polarity data expressing binary number "1". On the other hand, if pieces of fundamental frequency data have negative numbers, the pieces of fundamental frequency data are replaced with pieces of polarity data expressing binary number "0". As a result, bit strings are left in the random access memory 12.

Subsequently, the central processing unit 10 superimposes the basic images 41*a* to 41*e* or 41*f* to 41*j* through the arithmetic mean of the bit strings. The arithmetic mean on the basic images 41*a* to 41*e* or bit strings 41*a* to 41*e* results in pieces of gradation data 32*a*, and the arithmetic mean on the basic images 41*f* to 41*j* results in pieces of gradation data 32*b*. Thus, the central processing unit 10 produces the pieces of gradation data through the arithmetic mean on the bit strings 41*a* to 41*e* or 41*f* to 41*i* as by step S48.

Finally, the central processing unit 10 supplies the pieces of gradation data to the graphic controller 15, and the graphic controller 15 produces the gradation image 32*a* or 32*b* on the area 31 as by step S49. Since the fundamental frequency of audio signal 40*a* is equal to the target frequency Hz already modified with the deviation x, the bit strings 41*a* to 41*e* are equal to one another, and the pieces of gradation data is expressed by the bit string same as the bit strings 41*a* to 41*e*. Accordingly, the graphic controller 15 produces the two-tone gradation image 32*a* from the pieces of gradation data.

On the other hand, the fundamental frequency of audio signal 40*b* is less than the target frequency Hz so that the bit strings 41*f* to 41*j* are different from one another. As a result, more than two different numbers express the pieces of gradation data. For this reason, the graphic controller 15 produces more than two tones in the gradation image 32*b*.

Thus, the main routine program periodically branches to the subroutine program SB1A, and the gradation image 32*a* or 32*b* is periodically renewed in the area 31. When the user feels the gradation image 32*a* or 32*b* vague, he or she gives the positive answer "Yes" at step S22, and inputs a different size into the portable tuning device. Then, the length of window becomes less than 2.5, and the central processing unit 10 instructs the graphic controller 14 to produce a part of the gradation image 32*b* at a large magnification ratio at step S29. The part of gradation image occupies the entire area 31. Thus, the tuning device 1A makes the user clearly see the difference from the target frequency Hz.

Although the method for visualizing the phrase difference is different between the first embodiment and the second embodiment, the deviation x is taken into account in account for both embodiments, and the tuning devices 1 and 1A make it possible to assist the users in the tuning work on musical instruments, accurately.

Although particular embodiments of the present invention have been shown and described, it will be apparent to those skilled in the art that various changes and modifications may be made without departing from the spirit and scope of the present invention.

The pieces of fundamental data may be modified with the deviation x without correction of the target frequency Hz.

The deviation x may be taken into account for estimating the pitch of tones. In detail, if the user produces a tone without any input of a pitch name at step S16, the main routine program periodically branches to a subroutine program for estimating the pitch of tones through an autocorrelation. Various methods for the autocorrelation have been already taught in documents, and one of the methods is disclosed in Japanese Patent Publication No. Hei 3-42412. The tuning device samples discrete values on the audio signal, and converts the discrete values to bits "1" and bits "0" depending upon the polarity. Thus, the discrete values are converted to a bit string. The tuning device repeatedly introduces a delay time equivalent to the time period between zero-crossing points on the time base for producing delayed bit strings, and calculates the autocorrelation between the bit string and the delayed bit strings. When the tuning device finds the maximum autocorrelation between the bit string and one of the delayed bit strings, the tuning device calculates the repetition period or frequency of the basis of the delay time. Since the delay time is determined on the basis of the frequency of the sampling signal, the deviation x is eliminated from the design frequency, and the actual frequency makes the estimation more reliable than the estimation without consideration of the deviation x.

A portable tuning device according to the present invention may be implemented by other sorts of general-purpose information processing device such as, for example, a wrap-top personal computer system or a mobile telephone.

The jobs at steps S10 to S15 may be executed in an order different from those illustrated in FIG. 7A.

The target frequency may be determined through a calculation on the basis of the temperament theory instead of the use of tuning curve.

The tuning device may be used in a tuning work on another sort of musical instrument such as, for example, other sorts of keyboard musical instruments, stringed musical instruments, wind instruments and percussion instruments.

The calendar signal may be replaced with another sort of periodical signals already produced in the information processing device in so far as the periodical signal has the deviation less than the maximum cent value for the musical instrument. For example, the timer 12*a* may be driven with a system clock signal. Otherwise, a high-precision oscillator may be newly installed in the information processing device. The high-precision oscillator may be provided outside of the tuning device so that the periodical signal is supplied from the outside of the tuning device.

The calendar clock signal may be produced by a high-precision oscillator different from the oscillator, which supplies the clock signal to the demultiplier 14*a*.

The central processing unit 10 may requests the graphic controller 15 to produce images of hands on a clock driven for rotation with the calendar clock signal. A well-known subroutine program forms a part of the computer program, and the main routine program periodically branches to the subroutine program for incrementing the time and date.

The deviation may be determined for an audio clock signal used in an output circuit of the audio interface.

In case where an EEPROM (Electrically Erasable and Programmable Read Only Memory) device is incorporated in the read only memory 11, the deviation may be stored in the EEPROM before delivery to a user. In this instance, the subroutine program for the determination of deviation may be executed only when the user wishes to check the audio clock signal for the reliability on the report of the tuning device.

Sixteen minutes does not set any limit to the technical scope of the present invention. As described hereinbefore, the time period T is dependent on the accuracy of tuning status-for a musical instrument. If the accuracy to be required is severe, the time period T is longer than sixteen minutes.

The touch-panel liquid crystal display panel 3 does not set any limit to the technical scope of the present invention. An array of light emitting diodes or a CRT display may be used in the tuning work.

The computer program in the tuning device may be offered to users in the form of a compact disk or through downloading from a program source.

Claim languages are correlated with the component parts and/or steps described in the above-described embodiments as follows.

Figure 5:
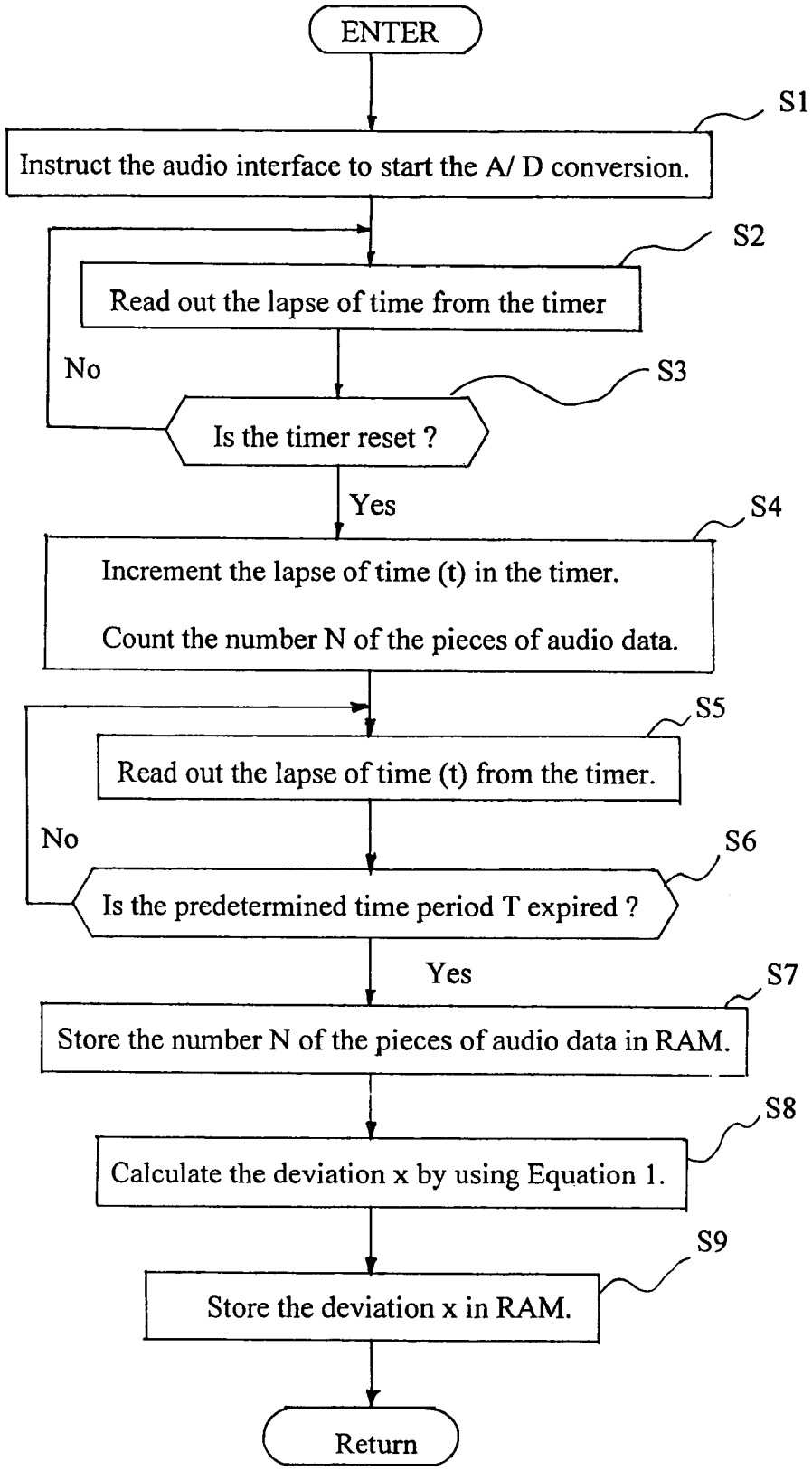
FIG. 5 is a flowchart showing a sequence of jobs for determining deviation of an actual frequency from a design frequency.

The microphone 4 or 4A and audio interface 14, which includes the analog-to-digital converter 14*a*, form in combination an "input circuit", and the data processing system 1*b* and subroutine program shown in FIG. 5 as a whole constitute a "determiner". The data processing system 1*b*, main routine program shown in FIGS. 7A and 7B and subroutine program SB1 or SB1A as a whole constitute an "informant". The upright piano 2 is corresponding to a "musical instrument". The audio clock signal SML and calendar clock CLD serve as a "sampling signal" and a "reference signal", respectively, and the gradation image 32 or 32*a*/32*b* expresses a "piece of tuning information".

The central processing unit 10, clock window 35*a* in the touch-panel liquid crystal display device 3A and subroutine program as a whole constitute a "system component". The signal generator 13 and frequency demultiplier 14*a* serve as a "high-precision signal generator" and a "low-precision signal generator", respectively.

The central processing unit 10 and instruction codes at steps S17/S18 or S17/S18/S20 as a whole constitute a "corrector", the central processing unit 10 and instruction codes at steps S30 to S37 or S40 to S48 as a whole constitute a "data analyzer", and the central processing unit 10, graphic controller 15, area 31 and instructions at steps S38 or 49 as a whole constitute an "image producer". The gradation image 32 or 32*a*/32*b* serves as a "visual image".

What is claimed is:

1. A tuning device for assisting a worker in a tuning work on a musical instrument, comprising:

an input circuit for converting sound waves to an audio signal expressing music sound produced in said musical instrument in synchronism with a sampling clock having a design frequency with a relatively low accuracy;

a determiner supplied with a reference signal having a design frequency with a relatively high accuracy, and determining a deviation between said design frequency of said sampling clock and an actual frequency of said sampling clock by using said reference signal as a measurer; and an informant supplied with said audio signal, and producing a piece of tuning information expressing tuning status of said musical instrument on the basis of an actual frequency of said audio signal and said deviation.

2. The tuning device as set forth in claim 1, in which said determiner shares said reference signal with a system component prepared for a purpose different from the determination of said deviation.

3. The tuning device as set forth in claim 2, in which said system component increments at least time in response to said reference signal.

4. The tuning device as set forth in claim 1, further comprising a high-precision signal generator producing said reference signal and connected to said determiner, and a low-precision signal generator producing said sampling signal and connected to said input circuit and said determiner.

5. The tuning device as set forth in claim 4, in which said high-precision signal generator is further connected to a system component prepared for a purpose different from the determination of said deviation.

6. The tuning device as set forth in claim 1, in which said informant includes a corrector receiving a target pitch to be found in said music sound and determining a modified target pitch to be found in said music sound on the basis of said target pitch and said deviation, a data analyzer analyzing said audio signal to see whether or not an actual pitch of said music sound is equal to said modified target pitch and producing pieces of image information expressing difference between said actual pitch and said modified target pitch, and an image producer supplied with said pieces of image information so as to visualize said difference.

7. The tuning device as set forth in claim 6, in which said pieces of image information expresses a visual image in an area on a display panel.

8. The tuning device as set forth in claim 7, in which said visual image is stable in said area in the absence of said difference and moved in said area in the presence of said difference.

9. The tuning device as set forth in claim 1, in which said determiner counts the number of pieces of data forming said audio signal in a time period measured with said reference signal, and calculates said deviation on the basis of said target frequency of said sampling signal, the number of said pieces of data and said time period.

10. The tuning device as set forth in claim 9, in which said deviation is expressed as $$x=(N/F)/T$$

where x is said deviation, N is the number of said piece of data and T is said time period.

11. The tuning device as set forth in claim 10, in which said time period is determined on the basis of the amount of allowable error in said tuning work on said musical instrument.

12. The tuning device as set forth in claim 1, in which said input circuit, said determiner and said informant are provided in the form of a general-purpose information processing device and a computer program loaded in said general-purpose information processing device.

13. The tuning device as set forth in claim 12, in which said general-purpose information processing device is a PDA (Personal Digital Assistants).

14. The tuning device as set forth in claim 13, in which said PDA includes a data processing system, a display panel, a manipulating board and a microphone.

15. The tuning device as set forth in claim 14, in which said manipulating board is implemented by images of manipulators produced on said display panel.

16. A computer readable medium having a computer program for producing a piece of tuning information expressing tuning status of a musical instrument, comprising the steps of:

a) receiving a sampling signal having a design frequency with a relatively low accuracy and a reference signal having a design frequency with a relatively high accuracy;

b) determining a deviation between said design frequency of said sampling signal and an actual frequency of said sampling signal by using said reference signal as a measurer; and c) producing a piece of tuning information expressing tuning status of said musical instrument on the basis of an actual frequency of said audio signal and said deviation.

17. The computer readable medium as set forth in claim 16, in which said step b) includes the sub-steps of b-1) counting pieces of data forming said audio signal and the number of repetition periods of said reference signal;

b-2) checking the number of repetition periods to see whether or not a predetermined time period is expired, and b-3) calculating said deviation on the basis of the number of said pieces of data, said target frequency of said sampling signal and said predetermined time period.

18. The computer readable medium as set forth in claim 17, in which said deviation is expressed as $$x=(N/F)/T$$

where x is said deviation, N is the number of said pieces of data and T is said predetermined time period.

19. The computer readable medium as set forth in claim 16, further comprising the step of visualizing said piece of tuning information.

20. The computer readable medium as set forth in claim 16, in which a visual image is found to be stable in a displaying area in the absence of said deviation and moved in said displaying area in the presence of said deviation.

* * * * *